US010780555B2

(12) United States Patent
Putsch et al.

(10) Patent No.: US 10,780,555 B2
(45) Date of Patent: Sep. 22, 2020

(54) COMBINATION OF CONTROL CABINET KEYS

(75) Inventors: Ralf Putsch, Wuppertal (DE); Michael Feld, Cologne (DE); Filip Marovic, Wuppertal (DE)

(73) Assignee: KNIPEX-Werk C. Gustav Putsch KG, Wuppertal (DE)

( * ) Notice: Subject to any disclaimer, the term of this patent is extended or adjusted under 35 U.S.C. 154(b) by 1652 days.

(21) Appl. No.: 13/579,353

(22) PCT Filed: Feb. 17, 2011

(86) PCT No.: PCT/EP2011/052328

§ 371 (c)(1),
(2), (4) Date: Sep. 24, 2012

(87) PCT Pub. No.: WO2011/101397

PCT Pub. Date: Aug. 25, 2011

(65) Prior Publication Data

US 2013/0014616 A1 Jan. 17, 2013

(30) Foreign Application Priority Data

Feb. 17, 2010 (DE) ..... 10 2010 000 444

(51) Int. Cl.
*B25F 1/04* (2006.01)
*E05B 35/00* (2006.01)
(Continued)

(52) U.S. Cl.
CPC ..... *B25B 13/005* (2013.01); *B25B 13/56* (2013.01); *B25F 1/04* (2013.01); *E05B 35/008* (2013.01)

(58) Field of Classification Search
CPC ..... B25B 13/005; B25B 13/56; B25B 13/06; B25B 13/04; B25B 13/48; B25F 1/04; E05B 35/008
(Continued)

(56) References Cited

U.S. PATENT DOCUMENTS 910,789 A * 1/1909 Cunningham ..... B25B 13/06 7/101
4,236,266 A 12/1980 Hannah et al.
(Continued)

FOREIGN PATENT DOCUMENTS

DE 37 00 627 7/1988
DE 296 17 973 12/1996
(Continued)

OTHER PUBLICATIONS

International Search Report of PCT/EP2011/052328, dated Jun. 1, 2011.

*Primary Examiner* — David B. Thomas
(74) *Attorney, Agent, or Firm* — Collard & Roe, P.C.

(57) ABSTRACT

The invention relates to a combination (1) of control cabinet keys (2), individual keys being situated in the same plane but extending at a fixed angle (x) relative to one another and connected via a common center part (4, 5). Due to the fixed connection between the keys, during handling, a torque may be applied to a key (2) that is used. For ease of handling, a first unit ($E_1$) and a second unit ($E_2$) of keys extending at a fixed angle (x) relative to one another are provided, all units ($E_1$, $E_2$) have their own center part, and the units are detachably connected at their center parts (4, 5), and/or the keys are rotatable relative to one another, but only in a respective predefined plane.

24 Claims, 21 Drawing Sheets

(51) Int. Cl.
*B25B 13/56* (2006.01)
*B25B 13/00* (2006.01)

(58) Field of Classification Search
USPC ..... 81/121.1–125
See application file for complete search history.

(56) References Cited

U.S. PATENT DOCUMENTS 4,939,960 A * 7/1990 Kinzli ..... B25B 13/005 81/124.4
4,964,664 A * 10/1990 Crittenden ..... B25B 9/00 294/15
D344,664 S * 3/1994 Malkinson ..... D8/85
5,442,982 A * 8/1995 Bell ..... B25B 15/02 7/165
5,588,169 A * 12/1996 Chuang ..... B25B 13/56 7/138
5,655,242 A * 8/1997 Chuang ..... B25B 13/04 7/100
5,711,042 A * 1/1998 Chuang ..... B25B 13/56 157/1.3
D447,026 S * 8/2001 Barnes ..... D8/29
6,564,678 B1 * 5/2003 Wang ..... B25B 13/56 7/118
6,662,688 B1 * 12/2003 Avery ..... B25B 13/005 7/100
7,140,280 B2 * 11/2006 Hawkins ..... B25B 13/56 7/138
D575,122 S * 8/2008 Correa ..... D8/25
8,387,492 B2 * 3/2013 Liu ..... B25F 1/04 7/138
2006/0117914 A1 6/2006 Huan
2006/0236821 A1 10/2006 Liao

FOREIGN PATENT DOCUMENTS

DE 202 07 136 7/2002
DE 20 2005 002520 4/2005
DE 10 2005 003267 8/2006
DE 20 2009 005858 6/2009
EP 0 082 346 6/1983
EP 1 422 365 5/2004
EP 1422365 A2 * 5/2004 ..... B25B 13/005
GB 2 318 316 4/1998

* cited by examiner 14
5
26

7

7

7

7
3

7
3

7

7

7

7

4
26
14

1
27
24
4
27
27
21
21
21
2''
21
21
3
2
2'
22
5
23

COMBINATION OF CONTROL CABINET KEYS

CROSS REFERENCE TO RELATED APPLICATIONS

This application is the National Stage of PCT/EP2011/052328 filed on Feb. 17, 2011, which claims priority under 35 U.S.C. § 119 of German Application No. 10 2010 000 444.8 filed on Feb. 17, 2010, the disclosure of which is incorporated by reference. The international application under PCT article 21(2) was not published in English.

The invention relates in first instance to a combination of control cabinet keys, individual keys being situated in the same plane but extending at a fixed angle relative to one another and connected via a common center part, and due to the fixed connection between the keys, during handling, a torque may be applied to a key that is used.

The invention further relates to a combination of control cabinet keys, individual keys being provided extending at an angle relative to one another, and by use of a center part which connects these keys, during handling, a torque may be applied to a key that is used.

These types of combinations of control cabinet keys are already known in diverse aspects. Reference is made to DE 296 17 973 U1, for example. The combinations are used in particular for activating locks on control cabinets, as well as on shutoff systems for gas, water, and electrical power supply units. The keys usually have a combination in particular of a 6-mm square and/or a 8-mm square and/or a 10-mm square and/or a 6-mm triangle and/or a 8-mm triangle and/or a 10-mm triangle and/or a hexagon and/or a crescent and/or a double bit and/or a step-like external square, for example in a dimension range of 6 to 9 mm, and/or a double bit insert. Within the scope of the present invention, it is preferred that one or more of the mentioned keys, in particular also all of the keys mentioned are provided on the combination in a combined manner.

It is an object to provide a combination of control cabinet keys which is easy to handle.

One possible approach to achieving the object, in first instance, is provided by an item in which a first unit and a second unit of keys extending at a fixed angle relative to one another are provided, each unit having its own center part and the units being detachably connected at their center parts. Thus, a multiplicity of keys may be transported in a combination, the keys often already being combined so that they are individually usable, but for a specialized use or also improved use, the keys also being usable by separating the units into a unit which is in each case customary in this respect, having, for example, four keys which are situated in a star shape relative to one another. A key of a unit that is separated in this way may be easily handled in the customary manner. In principle, it is also possible for each of the mentioned units to have individual keys, preferably formed according to the feature concept explained in greater detail below, namely, rotatable relative to one another in a predefined plane. With regard to the separable units, it may also preferably be provided that these units, although separable from one another, are not completely removable. The units may be held together by a connecting chain, for example, so that when one key in a separated unit is being handled, the other unit cannot be lost.

Another possible approach to achieving the object is provided in a combination in which the keys are rotatable relative to one another only in a plane which is predefined in each case. As a result of the rotatable arrangement of keys, more keys may be provided in the combination, basically extending in a star shape relative to one another, than is considered beneficial for customary handling. For handling, the other keys may then be turned away laterally with respect to the used key, so that the key to be used comes into an exposed position which allows ease of handling. However, as a result of the combination in the region of the center part, the necessary strength for allowing application of a torque is achieved.

Further features of the invention are described below, also in the description of the figures and in the drawings, often in their preferred association with the concepts of the claims explained above, but may also be of importance in an association with only one or more individual features which are described herein or illustrated in the drawings, in particular also single claims of claims 1 and 2 previously addressed, or in some other overall concept, for example, in particular also in an implementation in which the units are not separable or in any event are not easily operationally separable, or in which the combination of the units is even provided as a complete unit which cannot be disassembled.

It is also preferably provided that in the connected state, the keys of a first unit extend, at least in projection perpendicular to a plane in which the keys of a first unit extend, between two keys of a second unit. The keys may thus be arranged in a tiered manner one above the other, but offset relative to one another in projection, in particular extending in a star-shaped manner. Clarity regarding the overall available key is thus favorably achieved. In addition, an overall compact three-dimensional shape of the combination may also be achieved in this way.

It is also preferred that the units, as previously discussed, are captively connected. Instead of the mentioned chain connection, an articulated connection, for example, may also be provided.

Furthermore, it is preferred that the keys extend, starting from the same height band, with respect to base portions of the keys which are associated with the center part(s). The working heads of the keys, the same as for the previously known combinations, are each situated pointing outwardly, in particular radially outwardly. Accordingly, the oppositely situated regions of the keys are referred to as base portions. The arrangement of the base portions of the keys, which also preferably extend linearly overall, in the same height band results, in a manner of speaking, in a disk-like configuration of the combination in a side view. For this purpose, the base regions, in particular the geometric axes of the individual keys, do not have to be situated exactly in the same plane. With regard to the geometric axes, such a height band may extend over several millimeters, for example in the range of 1 to 10 mm, for example perpendicularly to the mentioned disk orientation. With regard to the embodiment having a plurality of units, this characterization refers to the assembled state of the units.

When the combination is composed of a plurality of units, as stated, a plurality of center parts is also provided for each of the separable units. In this regard, it is preferred that a base portion of a key in the connected state of the units extends in the direction of extent of the key, i.e., in a projection on the middle area in the longitudinal direction of the key, overlapping with two center parts. This may be achieved, for example, by the key being rooted in the one center part, but due to its shank thickness, for example, unobstructedly overlapping the other center part. Thus, a customary shank thickness which is desired for handling may be maintained, regardless of a possibly relatively thin formation of a center part. In addition, in their assembled form the units have a more organic action.

It may preferably also be provided that, viewed from a geometric center axis of the center part which correspondingly extends perpendicularly to a geometric longitudinal axis of a key, the distance up to the desired customary shank thickness or to the transition into the desired customary shank thickness is different. This may be further used to provide a corresponding flattened area on the oppositely situated center part in the radially outward region, so that a predefined positional orientation of the center parts relative to one another and/or (optionally additional) rotational locking may be achieved by engagement of the key with the shorter, thinned, shank region, the region which has a customary shank thickness and the transition thereto then actually engaging.

In the arrangement of the combination having a plurality of separable units, in the assembled form, these units are preferably connected to one another in an operationally detachable manner, i.e., more preferably by mutual handling which does not require insertion of a tool for the separation. This particular connection may be achieved by magnetic force, for example. However, the connection may also be provided by a detent lock, for example by a detent projection or the like which is retractable under a particular pressure.

In particular with regard to the keys which are rotatable toward one another or relative to one another, it may also be provided that the keys are rotatable in respectively different planes relative to their geometric longitudinal axes. This may be employed in particular to provide keys which are separable and removable.

The control cabinet keys may preferably have different lengths. The length refers to the dimension along the geometric center axis of the keys, measured from the midpoint of the center part, or measured from a corresponding geometric midpoint of the combination. With regard to such different lengths, it is preferred that the length of a control cabinet key having a greater length exceeds the length of a control cabinet key having a shorter length, in particular the length of an adjacent control cabinet key having a shorter length, by 10% or more, this being in principle applicable to all embodiments described herein. This is also of particular importance in the embodiment in which the control cabinet keys that have predefined angles are present in a non-rotatable manner relative to one another. The measure of implementing the control cabinet keys in this respect to be greatly different in length may result in the advantage that the use of a longer key is nonetheless made possible without separating a combination of a plurality of units. This difference in length may be up to 400%, for example, so that the control cabinet key of greater length has four times the length of the control cabinet key of shorter length.

Such a configuration is particularly preferred with regard to a control cabinet key which has a key bit. A bottom edge of the key bit, i.e., the edge of the key bit which is closest to the midpoint of the combination, is preferably provided in such a way that an imaginary extension of this border edge transverse to the geometric longitudinal axis of this control cabinet key does not collide with an adjacent control cabinet key of shorter length, and preferably does not collide with the two adjacent control cabinet keys of shorter length (one on each side in the peripheral direction). This control cabinet key may thus be inserted into a corresponding keyhole without this being prevented by the keys of shorter length. It is also preferred that a certain (additional) distance is provided between this imaginary extension, in the longitudinal direction of the geometric axes of the control cabinet keys of shorter length, and the start of a control cabinet key of shorter length.

A further teaching of the invention which is also important for these types of keys concerns the implementation of a tool key, in the present case in particular a control cabinet key having a polygon socket. For this purpose, it is preferably provided that a plurality of key widths is provided over the depth of the polygon socket. The polygon socket thus tapers in the depth direction, this taper preferably being step-like. In this regard, the transition does not have to be provided at right angles corresponding to a step surface, and instead may also be a cone having a relatively small cone angle, for example. The region of smaller key width, which, the same as the preceding region of greater key width, has a practically constant opening width over a corresponding depth, adjoins the taper in the depth direction.

In another preferred configuration of the control cabinet keys described herein, it is also provided that the external shape of a key corresponds to the internal shape. Thus, if a key has a triangle socket, for example, the head of the key in which the triangle socket is provided is also correspondingly formed as a triangle. The same applies for other polygon socket designs. Since these types of control cabinet keys are sometimes to be used in spatial conditions in which the lighting is not favorable, the correct key may be easily found solely by touch.

It is also preferred that the keys are combined lying one on top of the other on the center part which forms a common axis. This applies in particular for individual or detachable keys. In this regard, the center part is initially separated or separable from the keys. The keys may be combined, for example, by means of a central hole part on the common axis. In a preferred embodiment, the common axis may be composed of two interlocking axial parts. The axis parts may be joined to one another by a screw connection, for example. One or both axis parts may be formed so that they emerge from a retaining plate. In this case, one axis part, optionally together with a retaining plate, forms the center part.

It is also preferred that a key has a plate portion at its base which has an opening suitable for the common axis to pass through. Thus, the keys may be individually stacked one on top of the other in the region of their base parts, and secured in combination via the axis.

Instead of being rotatable relative to one another in different planes, it may also be provided that the keys are situated so that they are rotatable relative to one another in the same plane. In particular, this allows a relatively large base region of the keys in relation to the diameter without the overall thickness of the combination becoming too great.

In particular, it is preferred that a key forms a slide block at its base and is accommodated in a slideway of the center part. The key may thus be easily displaced while at the same time the necessary torque transmission is ensured.

In particular, the center part may also have an annular shape. When this embodiment is combined with the embodiment that provides a slideway in the center part, the slideway may be provided, for example, opening radially outwardly in the annular center part.

In particular, the center part may also be composed of two shell parts, each of which forms a part of the slide track.

It is also preferred that keys of different lengths are provided, in particular, that the working portions of the keys are located on different radii. It is further preferred in particular that a key having a greater length, i.e., of the extension in the direction of its longitudinal axis, is adjacent to two other keys of shorter length. As a result, the key of greater length, whose working portion protrudes a correspondingly farther distance, may also be used without the adjacent keys having to be turned away, or in the case of two individual parts, without these having to first be separated from one another.

With regard to the disclosure, the ranges and value ranges stated previously and below also include all values in between, in particular in 1/10 increments of the particular dimension, or if applicable, also for the case of dimensionless values, for example 1/10%, etc., on the one hand for delimiting the mentioned range limits from below and/or above, but alternatively or additionally, also with regard to the disclosure of one or more single values from a particular range.

The invention is explained in greater detail below with reference to the accompanying drawings, which, however, merely represent exemplary embodiments. The drawings show the following:

Figures 9A, 9B, 9C, 9D, 9E, 9F, 10A, 10B, 10C, 10D, 10E:
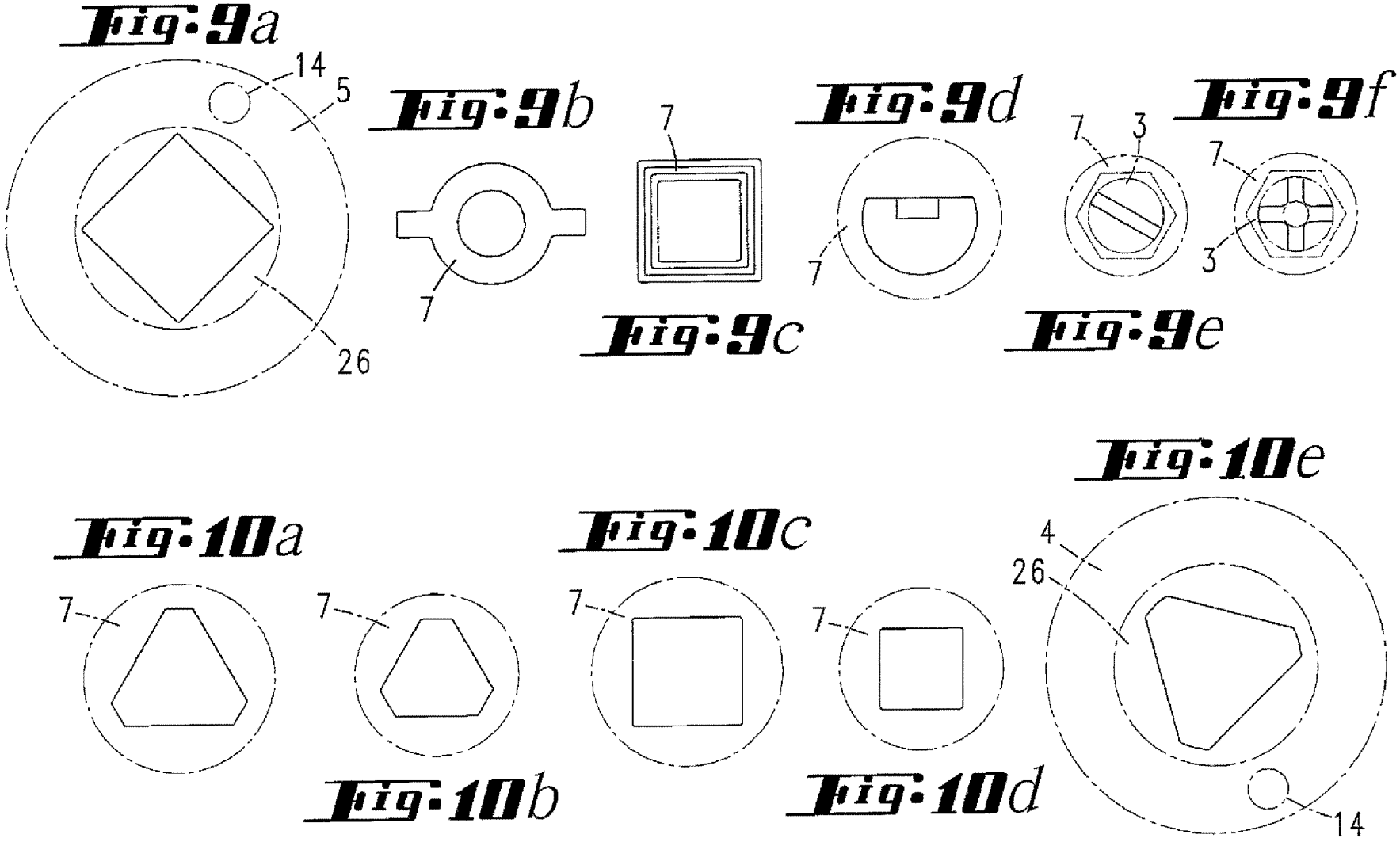

FIGS. 9*a* to show end-face views of possible key shapes; 9*f*

FIGS. 10*a* to show further end-face views of possible key shapes; 10*e*

Figure 11:
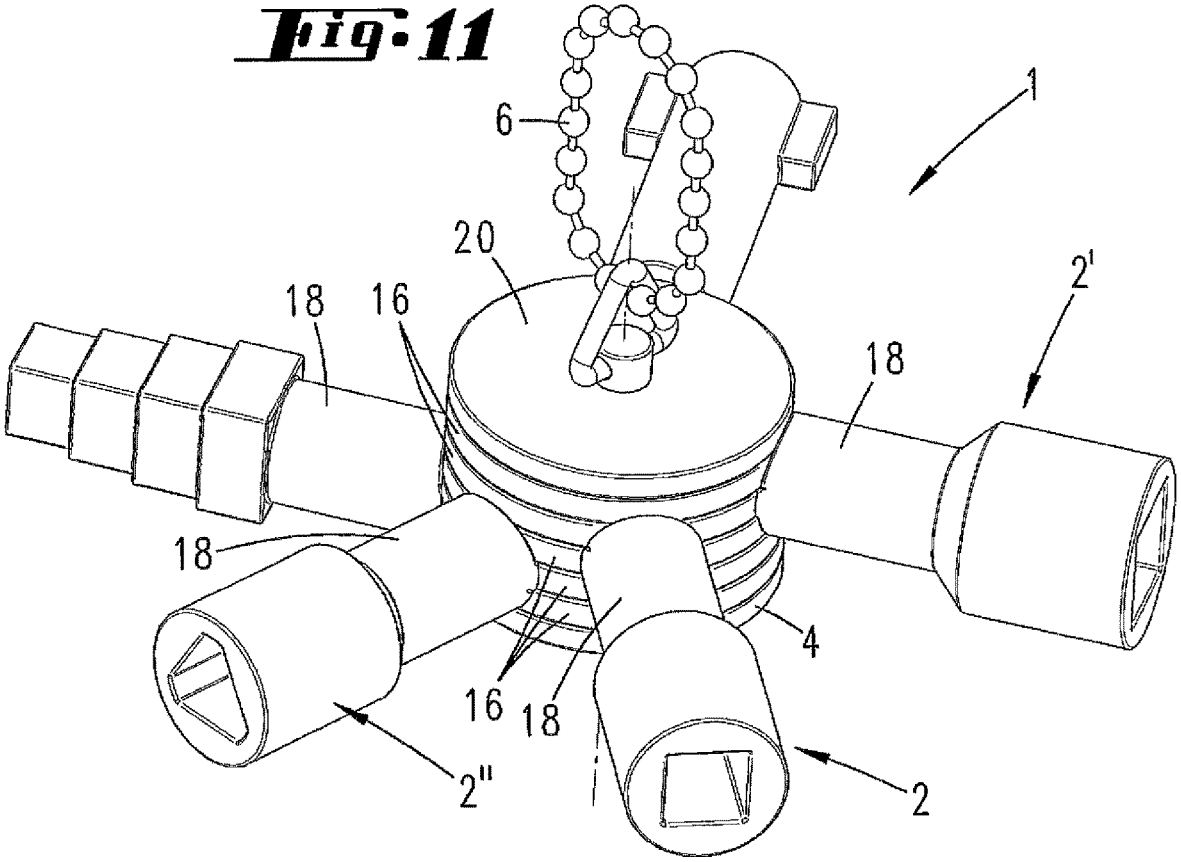
Figure 12:
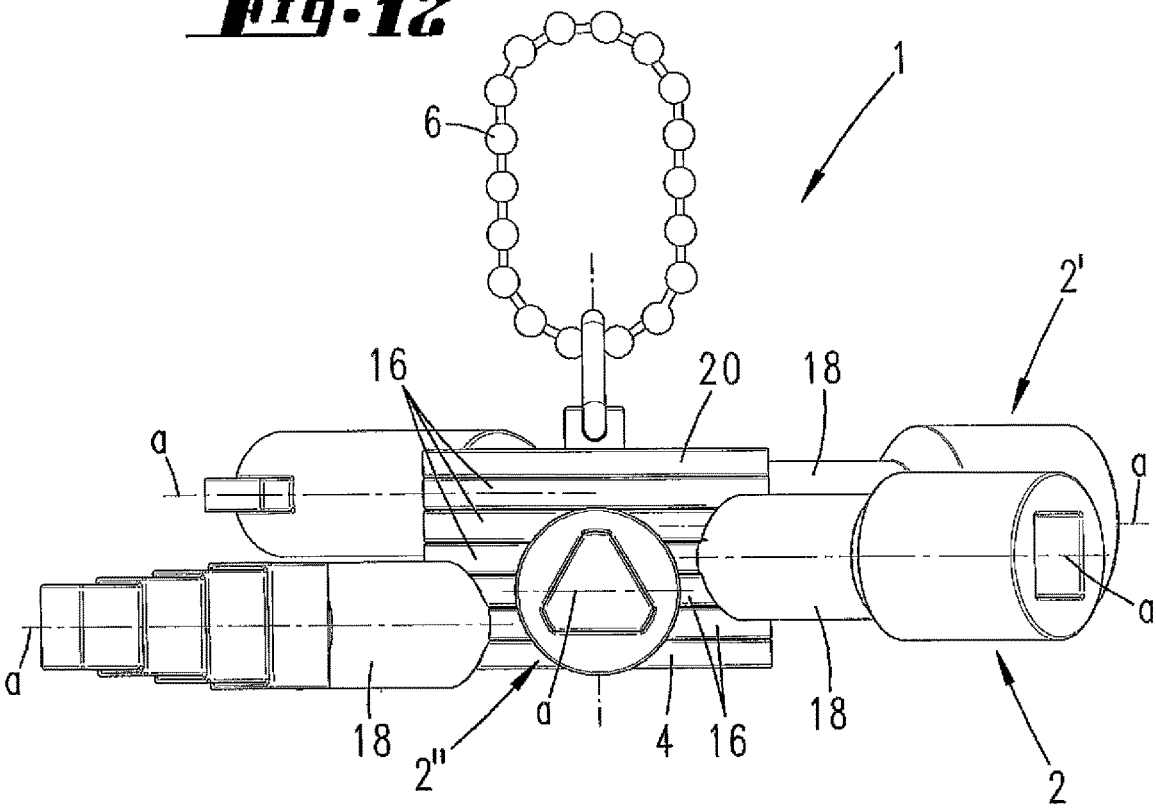
Figure 13:
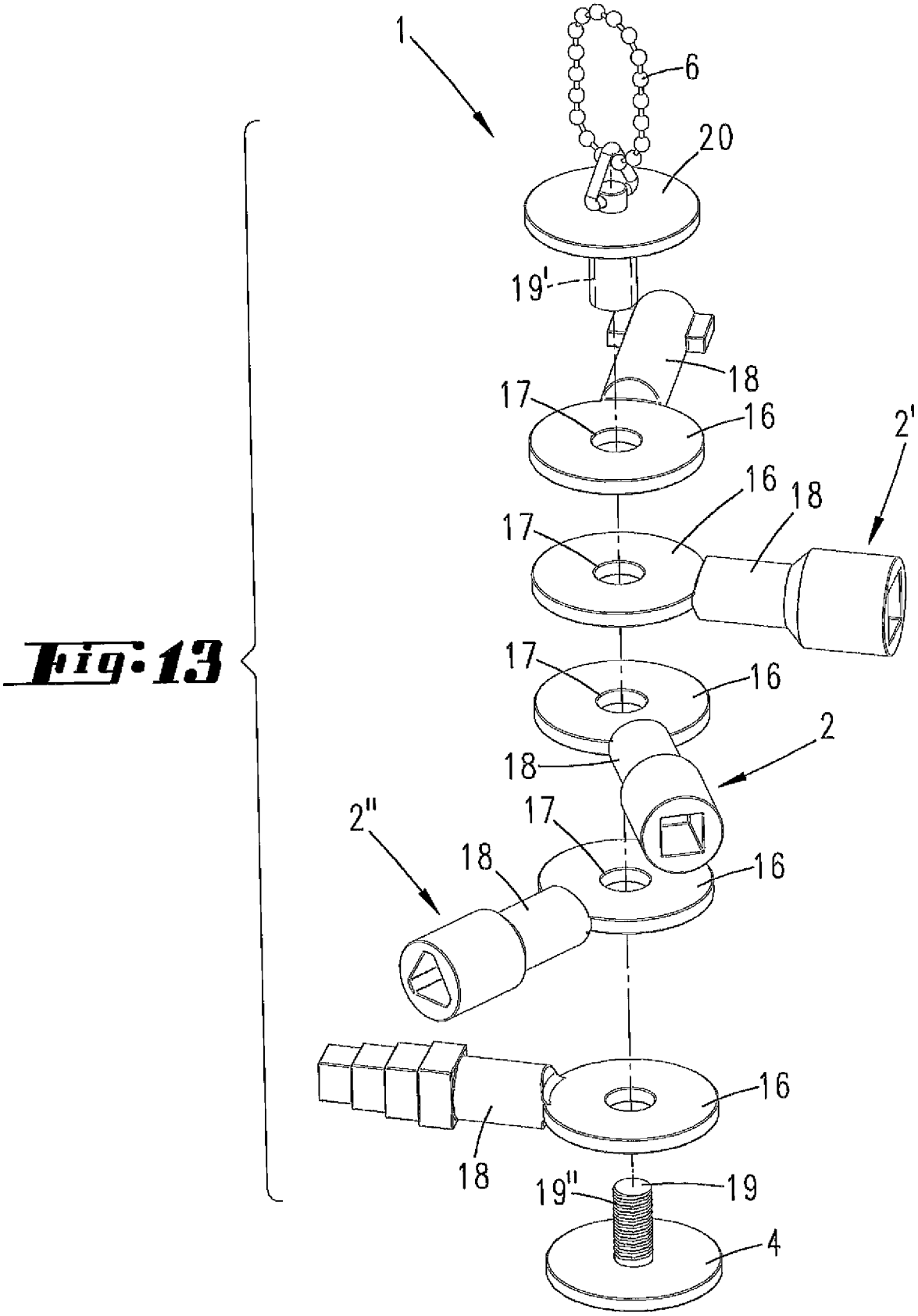
Figure 14:
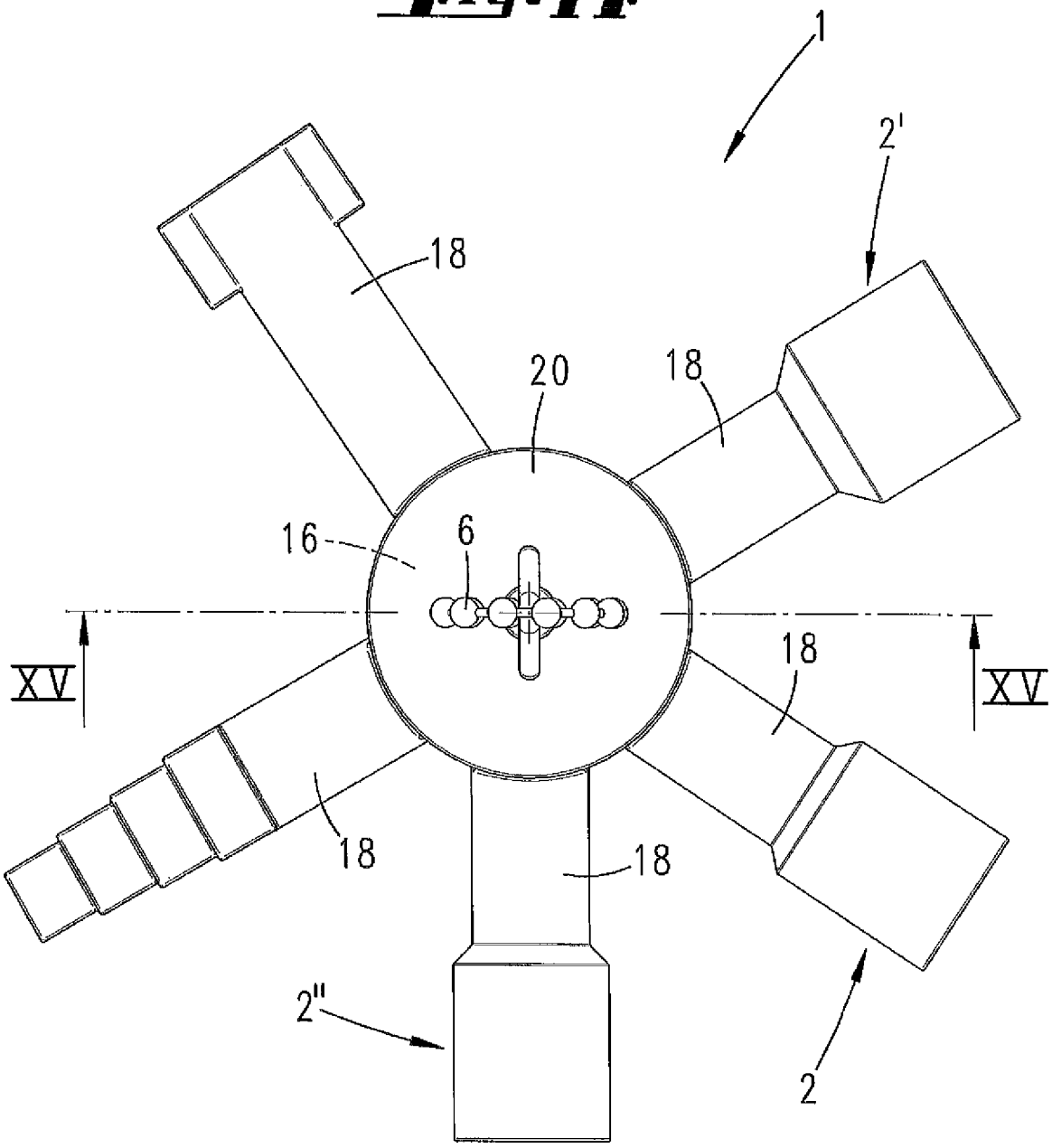
Figure 15:
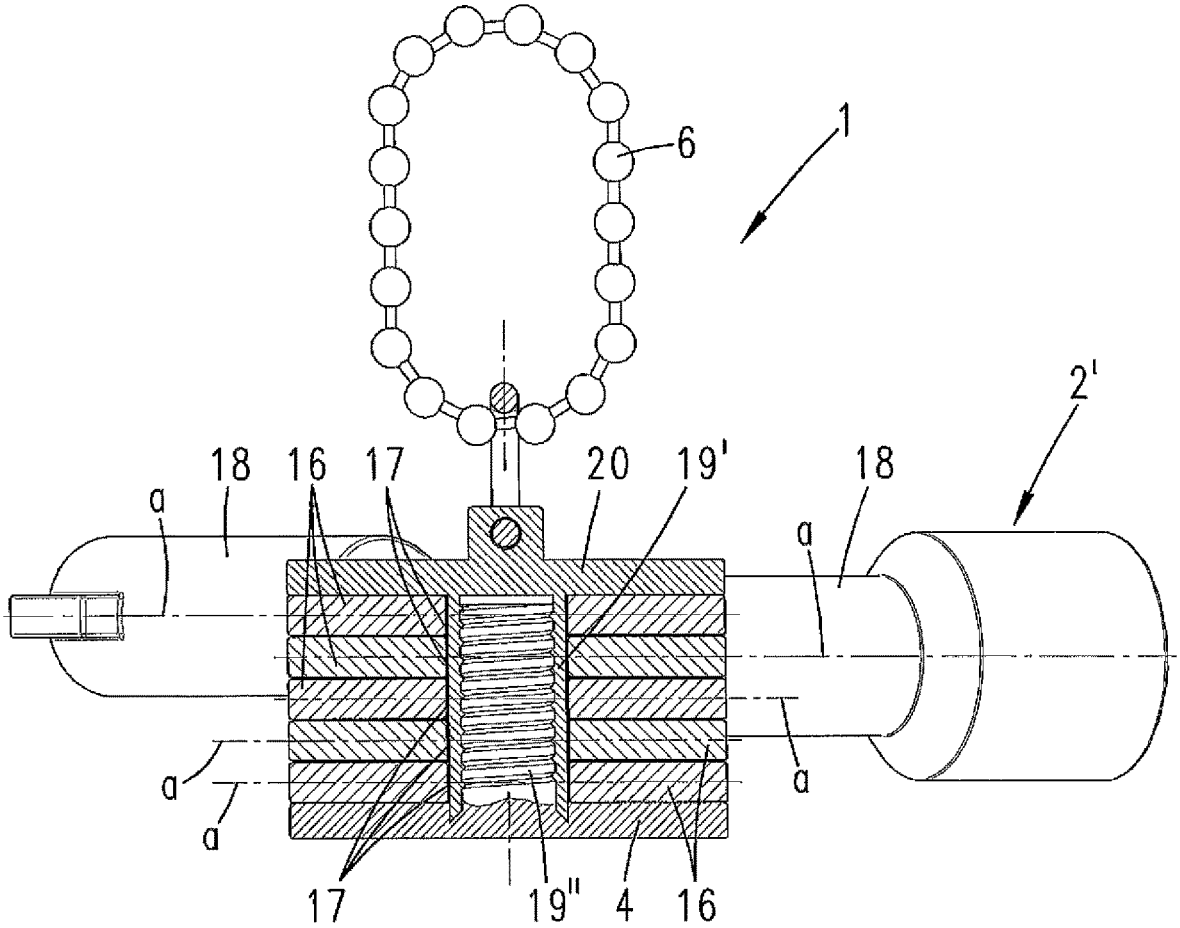
Figure 16:
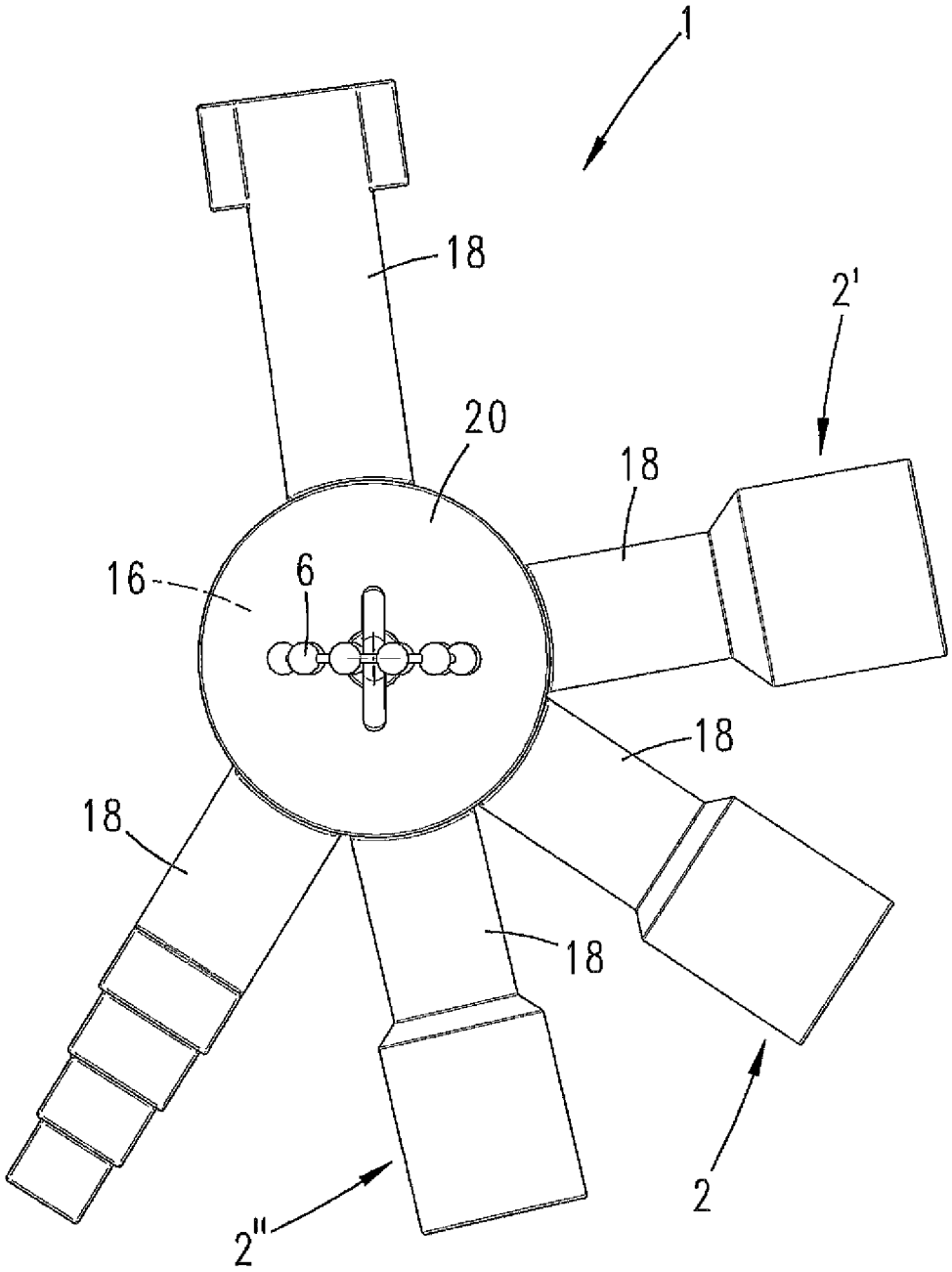
Figure 17:
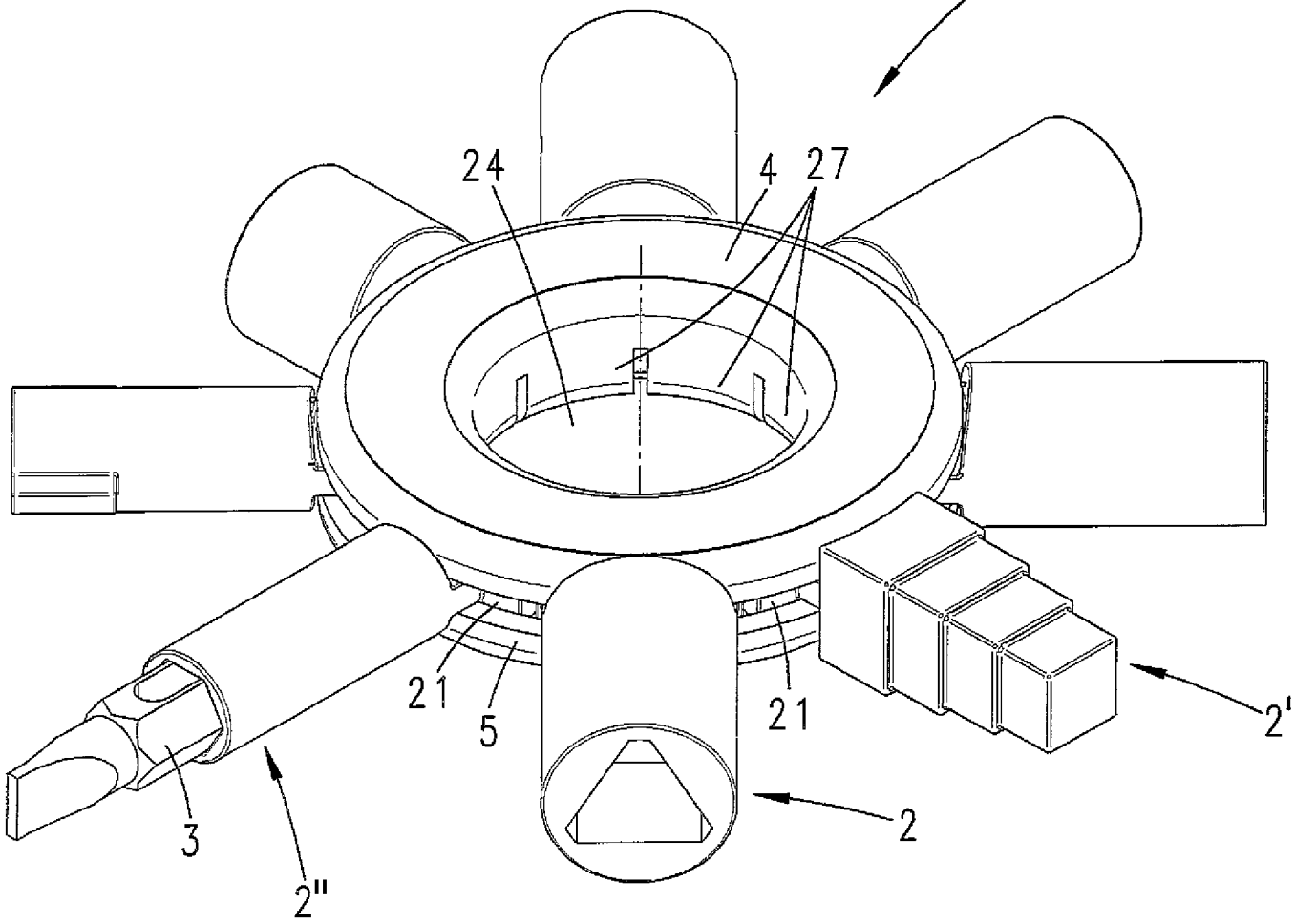
Figure 18:
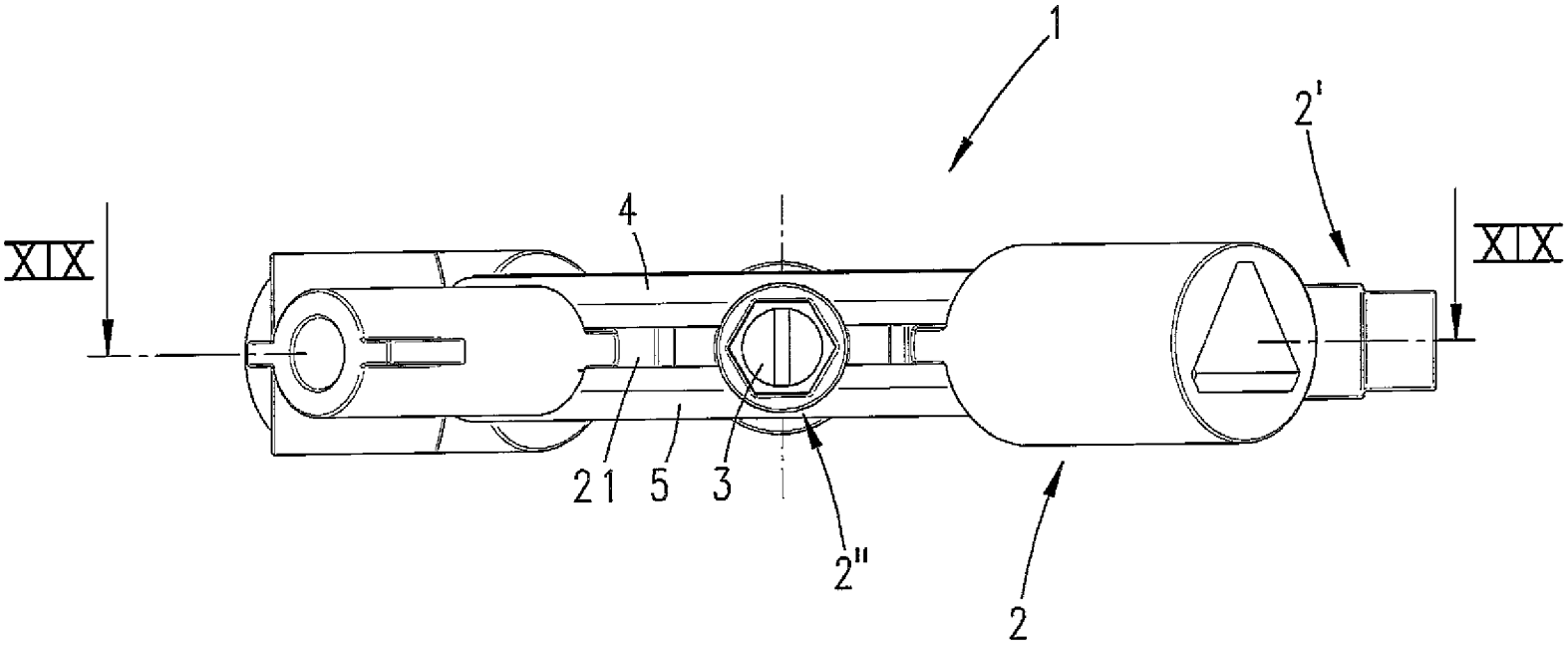
Figure 19:
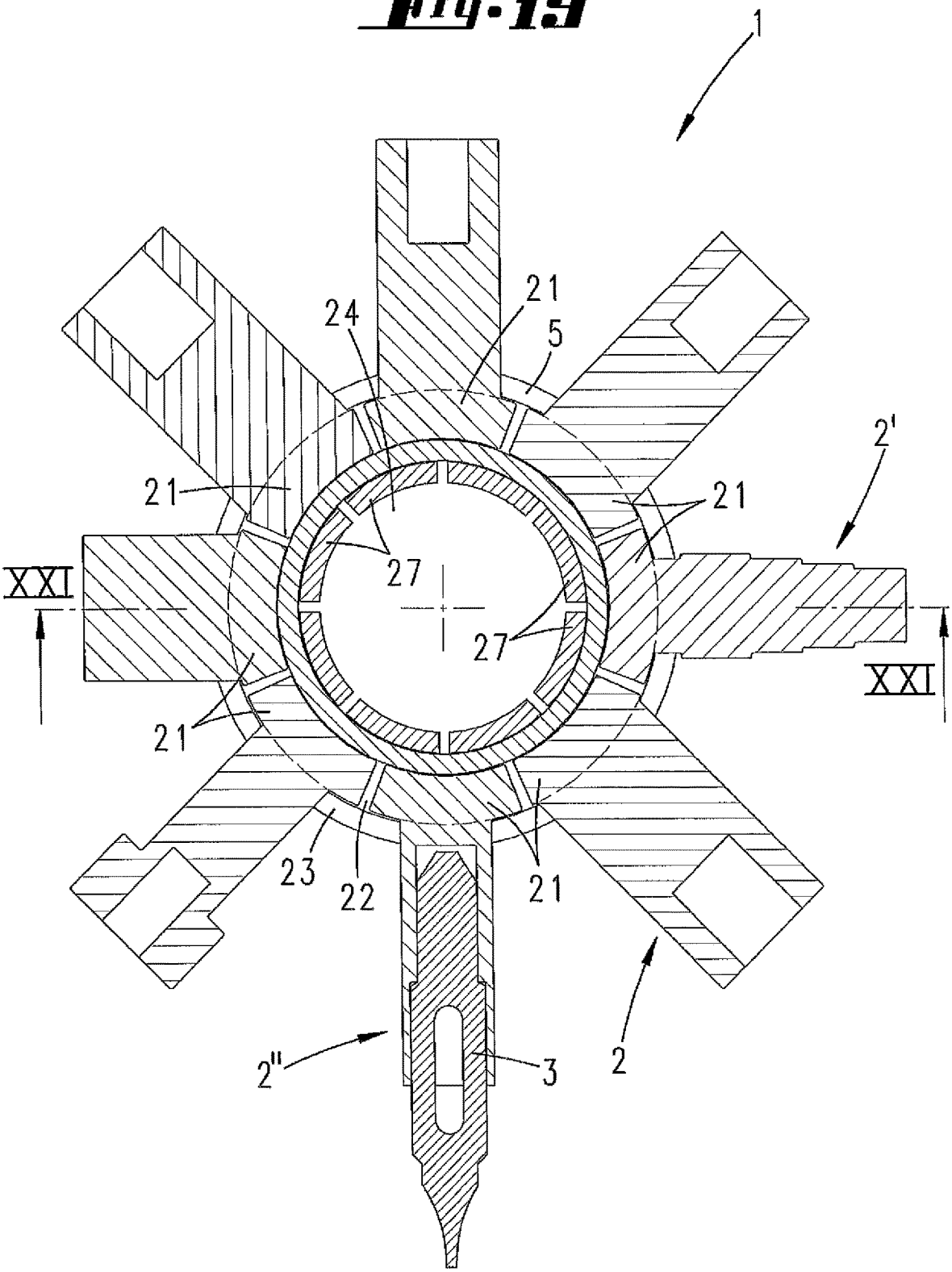
Figure 20:
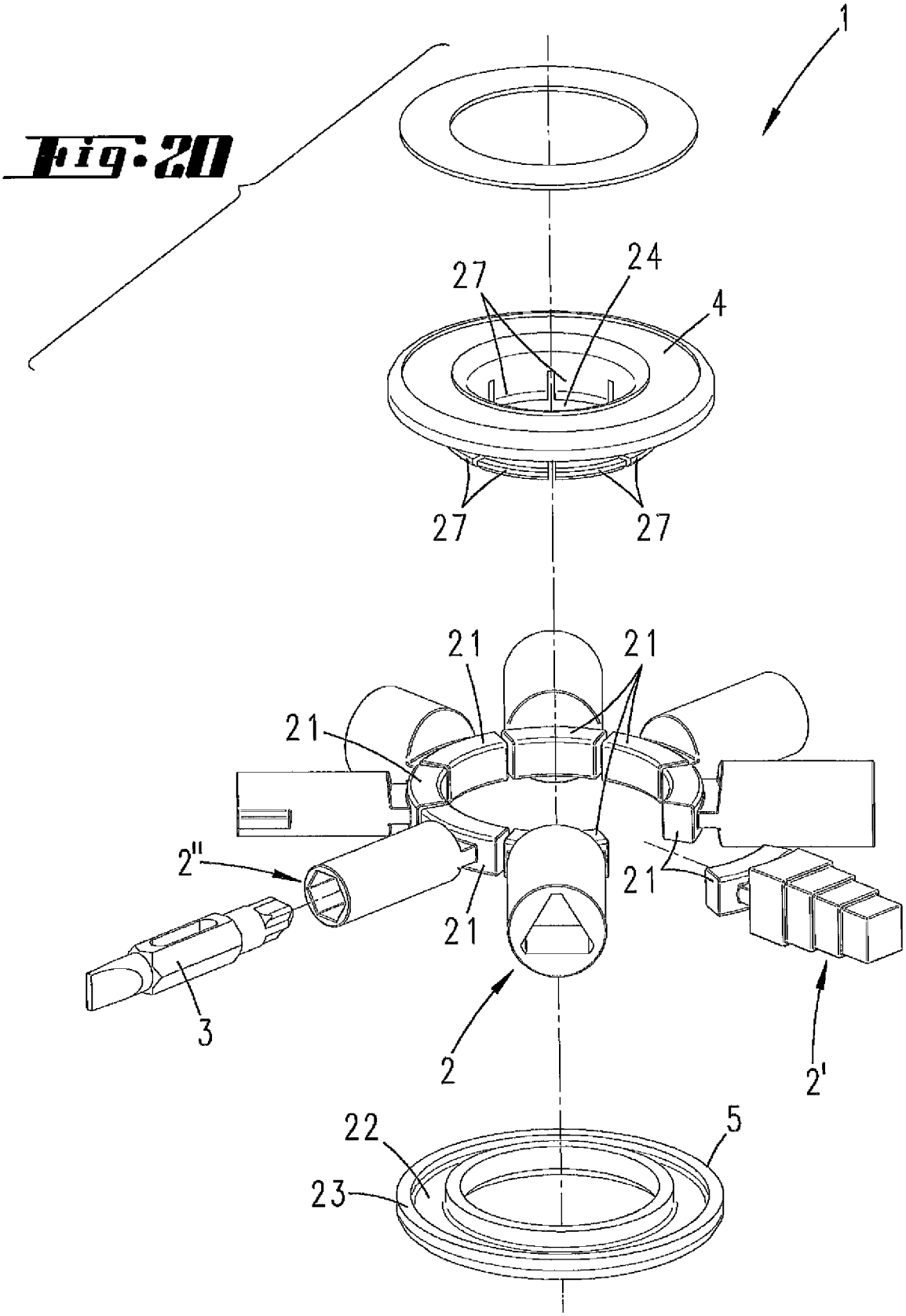
Figure 21:
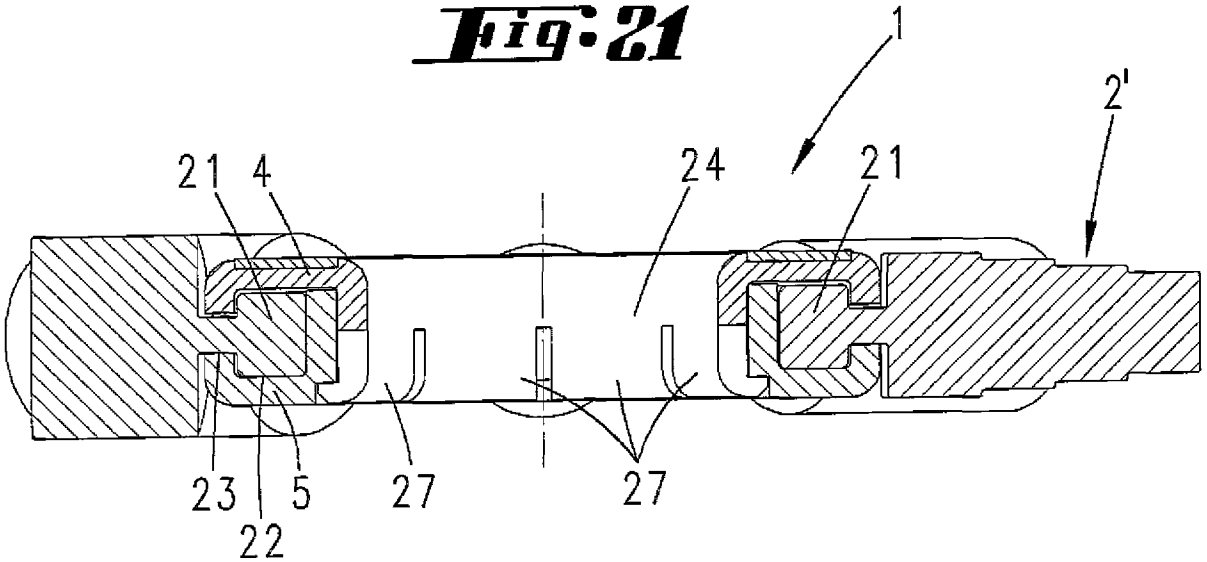
Figure 22:
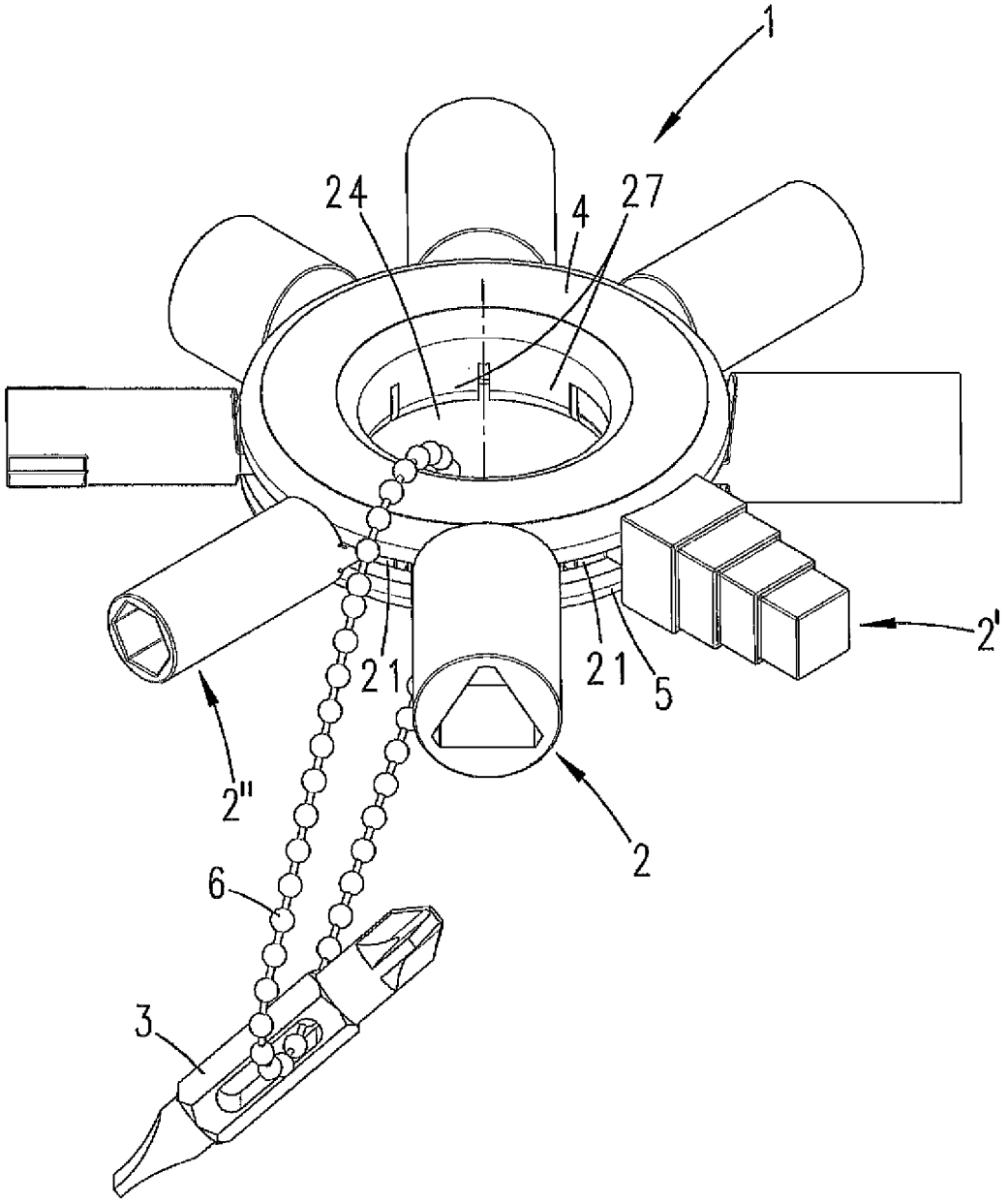
Figure 23:
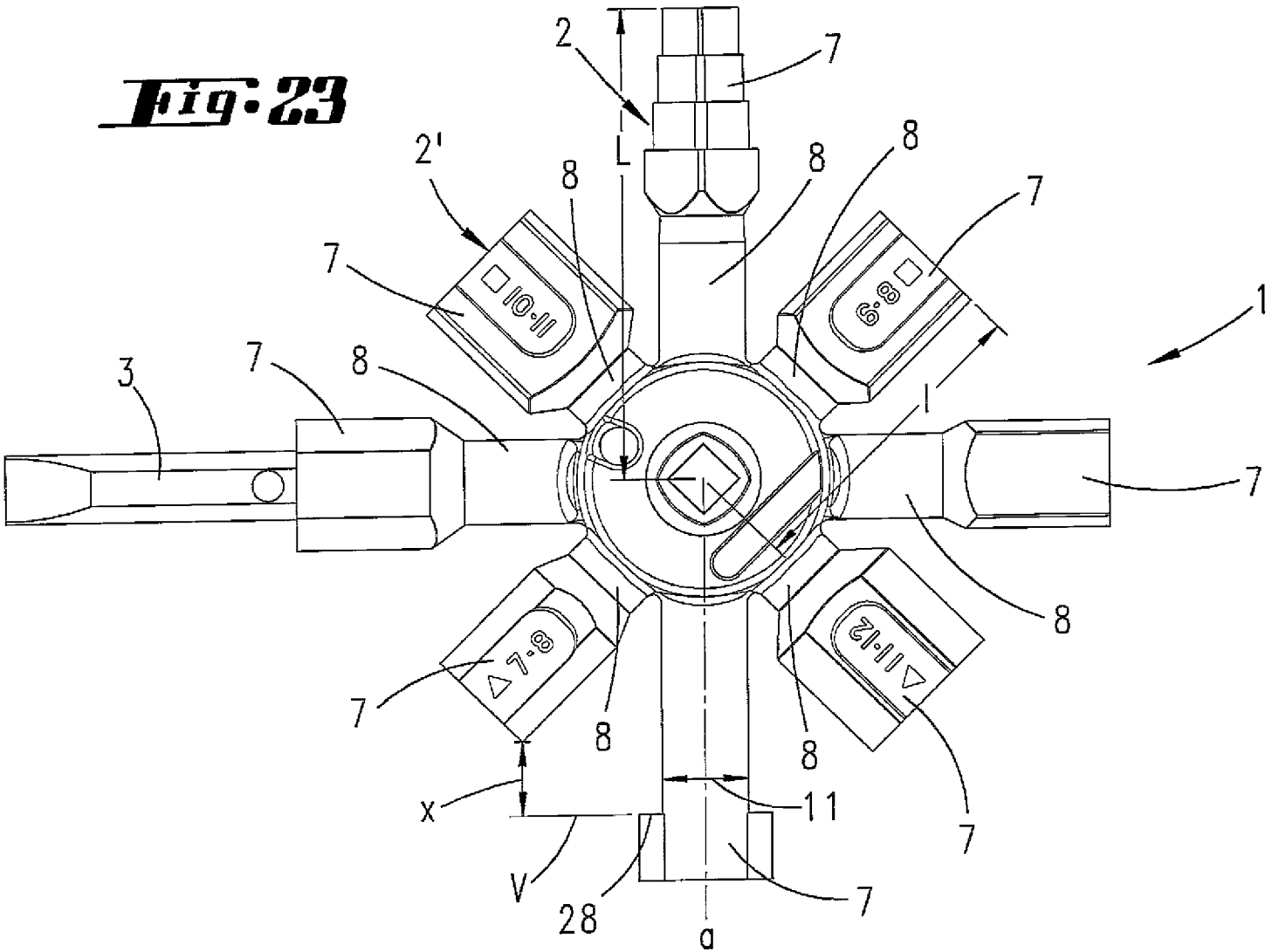
Figure 24:
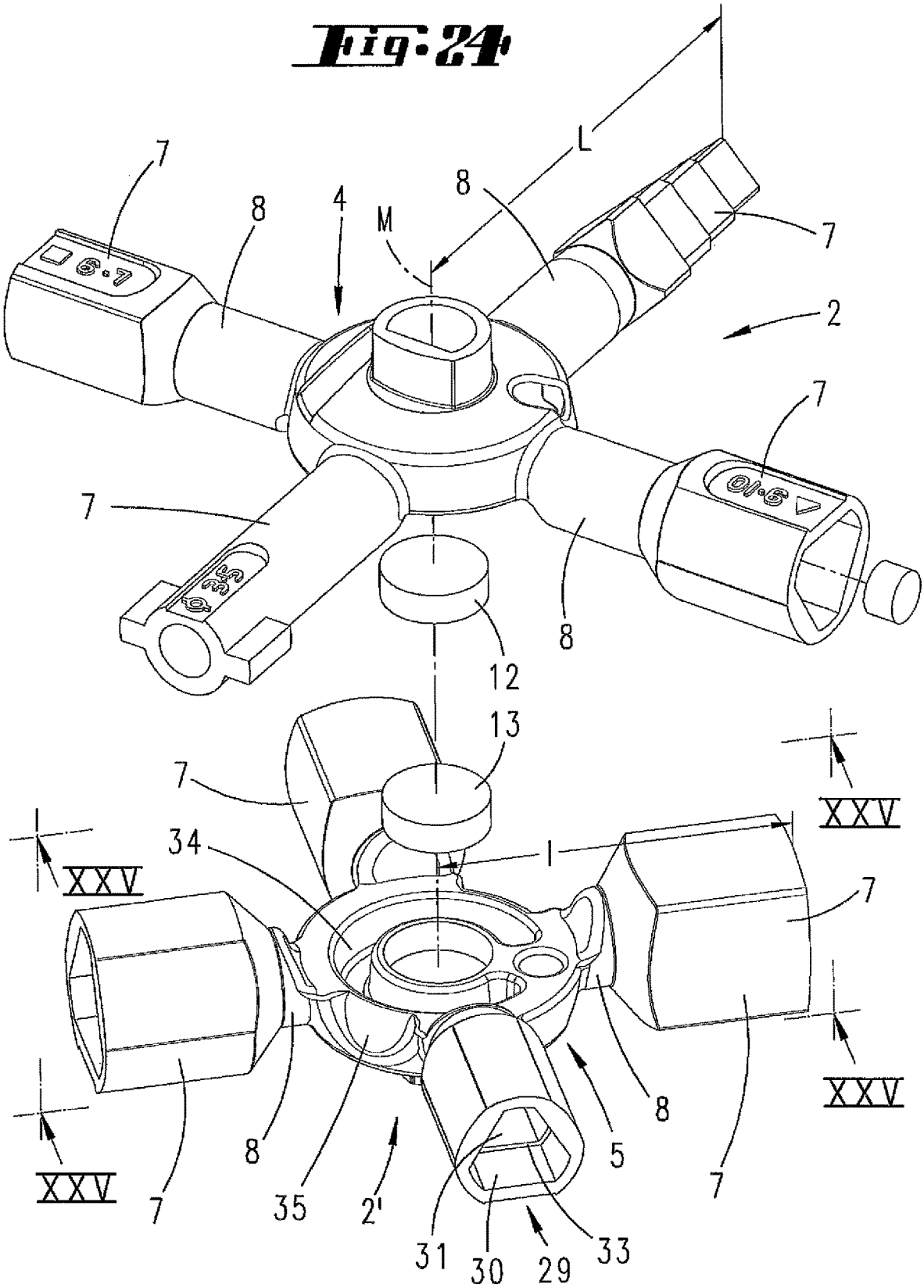
Figure 25:
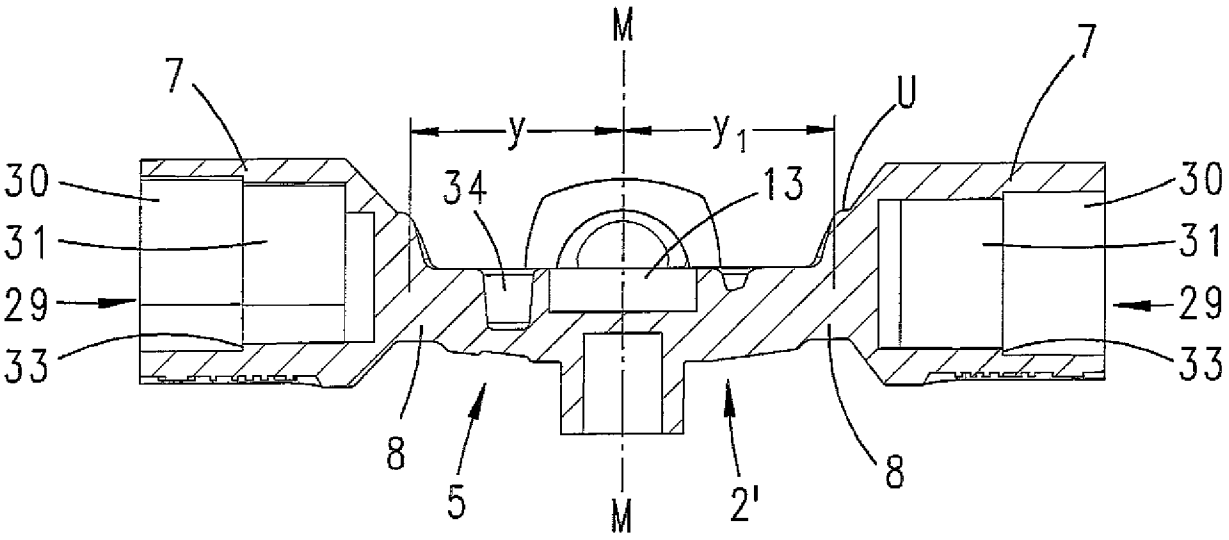

FIG. 11 shows a perspective view of another combination of control cabinet keys;

FIG. 12 shows the combination according to FIG. 11 in a side view;

FIG. 13 shows the combination according to FIG. 11 in an exploded illustration;

FIG. 14 shows the combination according to FIG. 11 in a top view;

FIG. 15 shows a cross-section of the subject matter according to FIG. 11 and FIG. 14, sectioned along the line XV-XV in FIG. 14;

FIG. 16 shows the illustration of the subject matter according to FIG. 11 in a handling position with regard to a selected key;

FIG. 17 shows a perspective illustration of another combination of control cabinet keys;

FIG. 18 shows a side view of the subject matter according to FIG. 17;

FIG. 19 shows a cross-section through the subject matter according to FIG. 17 and FIG. 18, sectioned along the line XIX-XIX in FIG. 18;

FIG. 20 shows an exploded illustration of the subject matter according to FIG. 17;

FIG. 21 shows a cross-section through the subject matter according to FIG. 17, sectioned along the line XXI-XXI in FIG. 19;

FIG. 22 shows another perspective illustration corresponding to FIG. 17, with a connected double-bit insert;

FIG. 23 shows a combination of further embodiments in the top view;

FIG. 24 shows the embodiment according to FIG. 23 in an exploded illustration; and FIG. 25 shows a cross-section of the subject matter according to FIG. 24, sectioned along the line XXV-XXV.

The embodiment of FIGS. 1 to 8 relates to a combination 1 of control cabinet keys 2, also having a double-bit insert 3 as also preferably provided in the exemplary embodiment. The individual keys 2 (see in particular FIG. 4) are each connected to a first center part 4 or a second shared center part 5. In principle, even further center parts of this type having control cabinet keys 2 connected thereto may be provided. The control cabinet keys 2 are connected to the center part 4 or 5 in each case, extending at a fixed angle $\alpha$ relative to one another. The control cabinet keys are preferably also here formed as one part. In the exemplary embodiment, the angle $\alpha$ marked off between the geometric longitudinal axes of the, i.e., two, adjacent control cabinet keys is 45°. However, the angle may also have a value, for example, of 20°, 30°, 40°, or any given values in between. As a result of the fixed connection between the keys and/or an arrangement of a key, which in any event is rotationally fixed with respect to a rotation about a longitudinal axis of a key, on the (respective) center part, a torque may be applied when a key is used in the customary manner.

The center parts 4, 5 are detachably connected to one another, as explained in greater detail below in conjunction with FIGS. 5 to 7.

The keys 2 which are connected to a center part 4 or 5 form a unit $E_1$ or $E_2$, respectively.

In addition, the units $E_1$, $E_2$, i.e., the center parts 4, 5, are captively connected to one another by a chain 6, for example. Even in the separated state, according to FIG. 4, for example, both of the center parts are prevented from possibly being lost.

Figure 1:
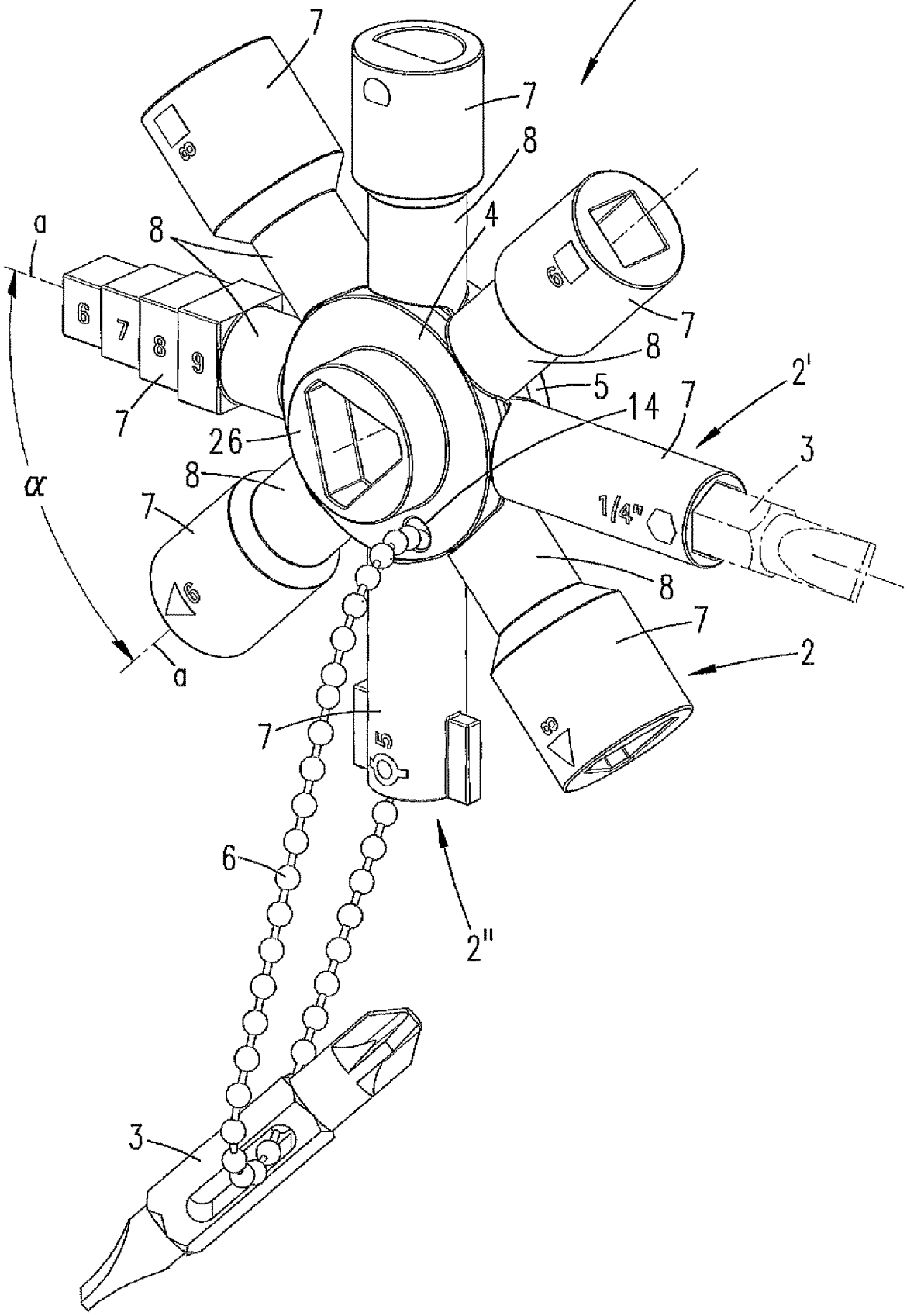
FIG. 1 shows a perspective view of a first embodiment.
Figure 2:
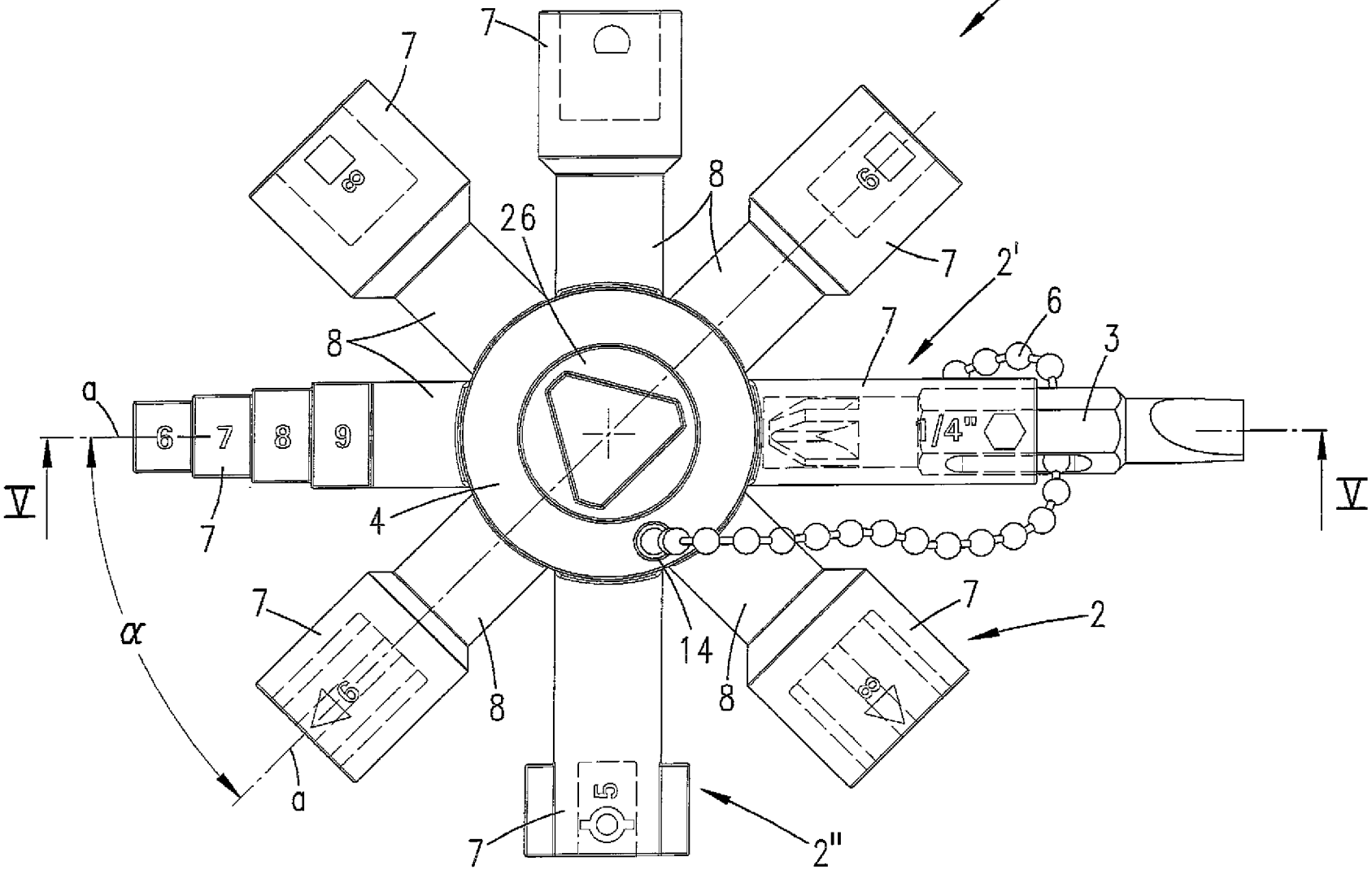
FIG. 2 shows the embodiment according to FIG. 1 in the top view.
Figure 3:
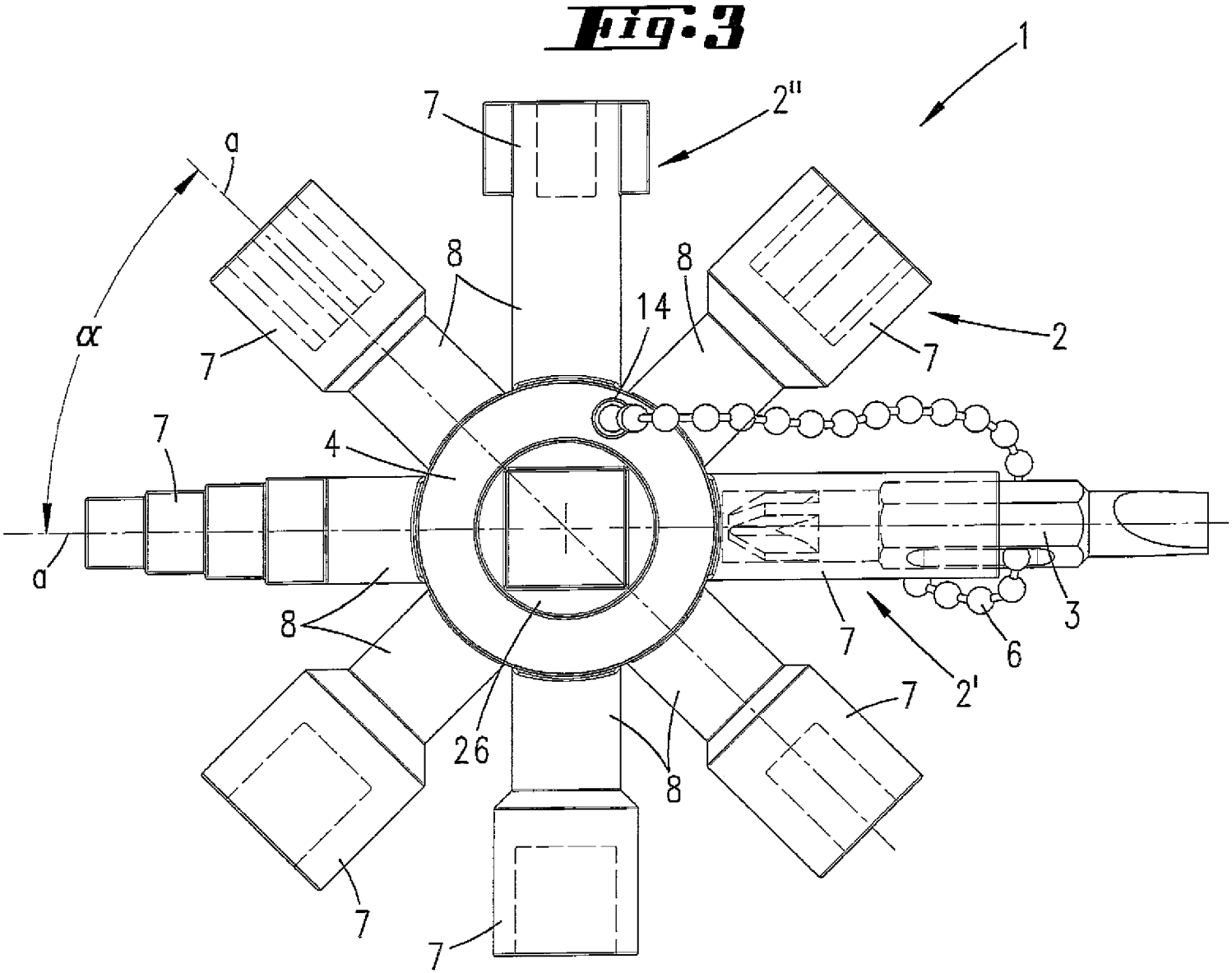
FIG. 3 shows the embodiment according to FIG. 1 in the bottom view.
Figure 4:
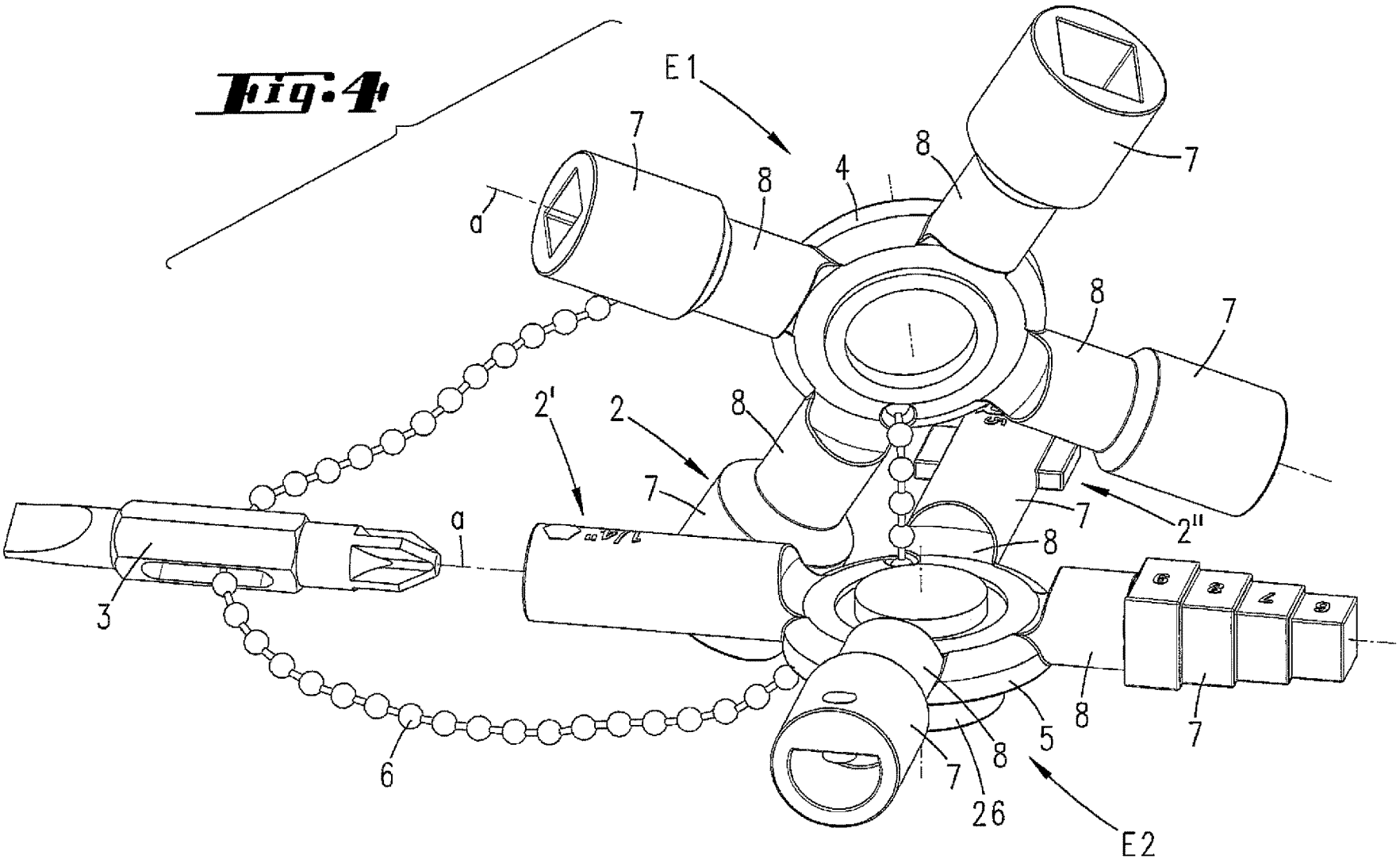
FIG. 4 shows the embodiment from FIG. 1 in the separated position of a first unit and second unit.

In the connected position of the combination, as is apparent from FIG. 1 but also in particular from FIGS. 2 and 3, a key 2 which in the exemplary embodiment is connected to the center part 4, for example, is located between two keys 2' and 2" which are connected to the center part 5. The keys 2, 2', and 2" extend as a whole in a star shape relative to one another, and preferably, as is also apparent from FIGS. 2 and 3, for example, at the same angle in projection, which in the exemplary embodiment is 45°, with respect to their geometric center axes a.

Each key 2 has a radially outwardly free-standing key head 7 and a key shank 8 extending opposite thereto toward the center. In the exemplary embodiments, the key shanks 8 in each case have a cylindrical shape. They may also have a rectangular or square cross-section, for example. In the combined state according to FIG. 1, for example, all keys 2, 2', 2" extend in the same height band b (see FIG. 5, for example), in the exemplary embodiment the geometric center axes a even being provided practically in the same plane. In addition, two oppositely situated keys 2 in each case are preferably provided with coinciding center axes a.

In the connected state of the units, a base portion 9 of a key 2 (see FIG. 5, for example) extends in the direction of extent of the key 2, overlapping with the two center parts 4, 5. The key 2 in the exemplary embodiment according to FIG. 5 is rooted only in the center part 5. However, due to the enlargement of its shank thickness, starting from a base region 10 directly adjoining the center part 5, up to a cross-section 11, the key is however preferably enlarged by the thickness of the second center part 4. The key is enlarged to approximately twice the thickness (relative to the dimension, visible in FIG. 5, for example, transverse to the extent of the geometric longitudinal axis) of the thickness in the base region.

Figure 5:
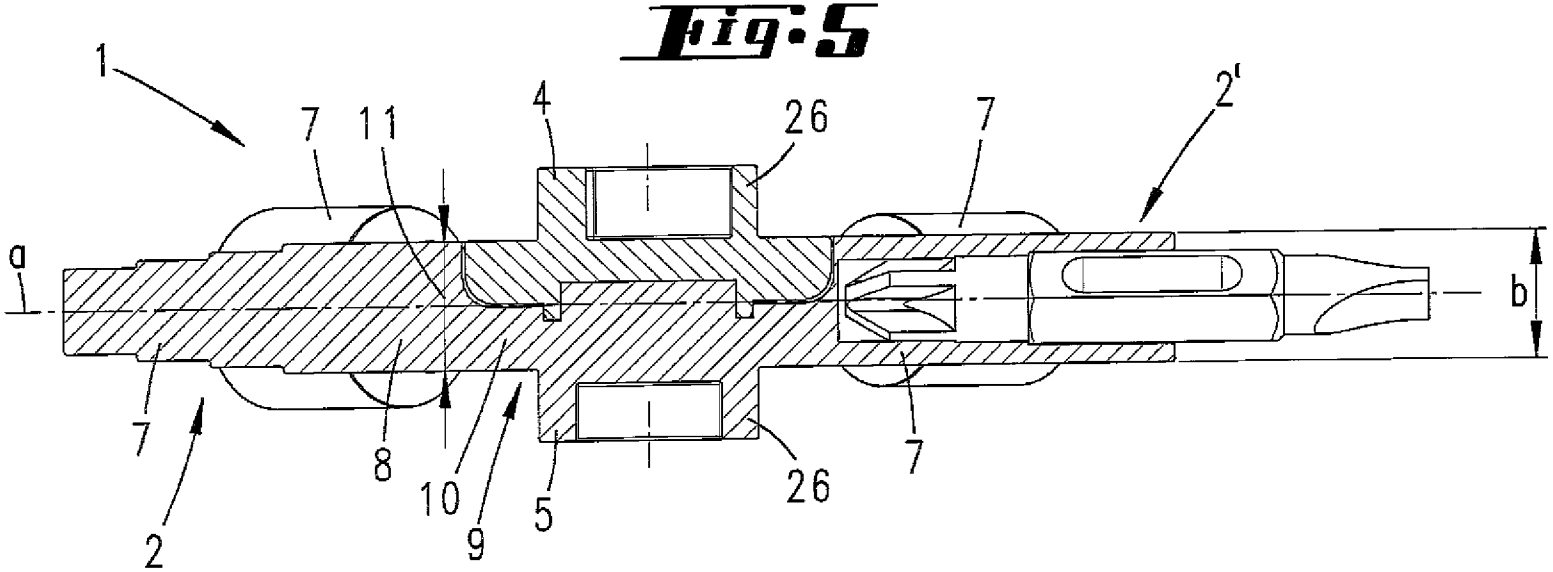
FIG. 5 shows a cross-section of the subject matter according to FIG. 1, sectioned along the line V-V in FIG. 2.

The connection of the two center parts 4, 5 and the key 2 thus connected thereto in each case may be established on the one hand by a simple plug-in connection, as illustrated in FIG. 5, in that a certain clamping action, for example, is produced.

Figure 6:
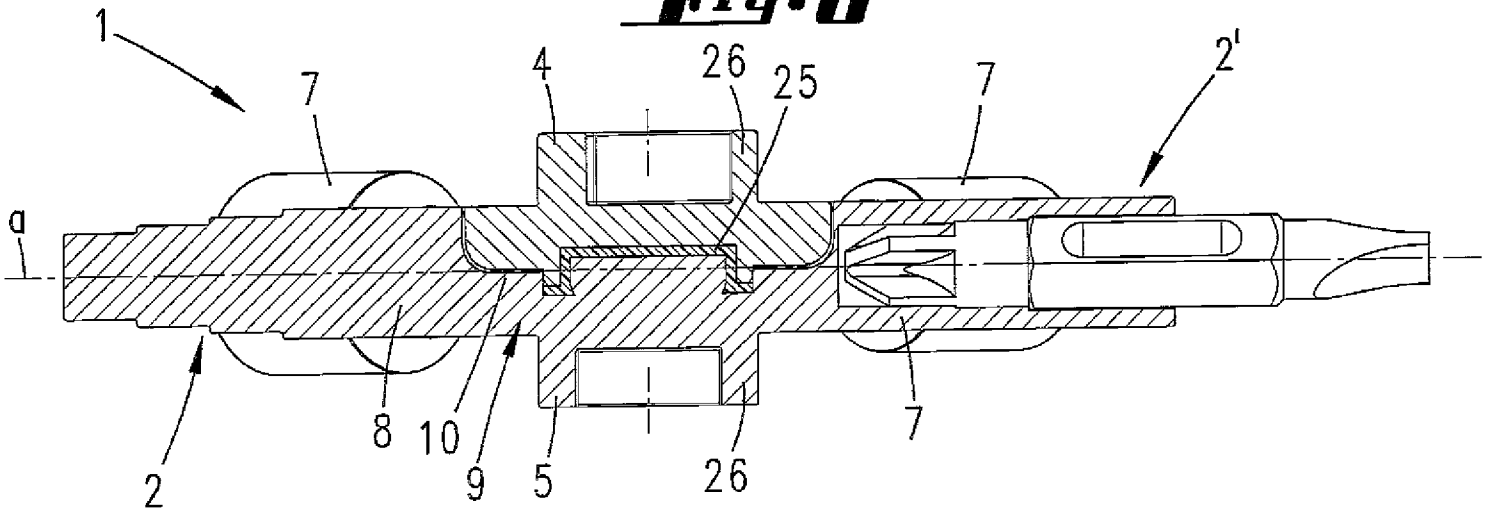
FIG. 6 shows an illustration corresponding to FIG. 5, but with a modified design in the region of the center parts.

To intensify this clamping action in a targeted manner, a plastics insert 25 as illustrated in the embodiment in FIG. 6 may also be provided in the interaction zone of the center parts. The plastics insert 25 results in a flexible mounting, so that the plug-in joining and connection may thus be advantageously brought about in the plugged-in state. The clamping action and/or plastics insert may also be provided in other embodiments, even if not separately described again below.

Figure 7:
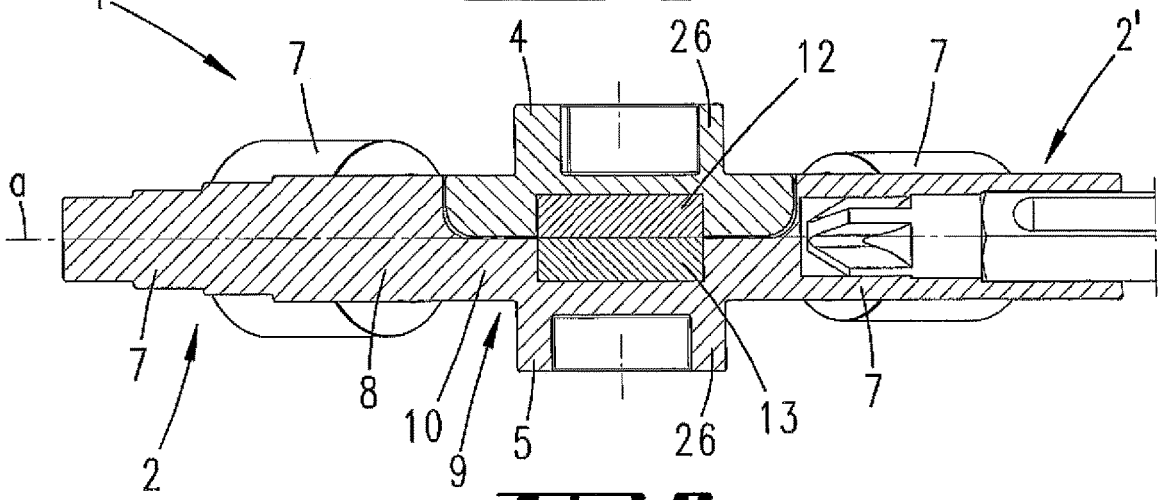
FIG. 7 shows another illustration corresponding to FIG. 5 and FIG. 6, with another modified design in the region of the center parts.

In the embodiment in FIG. 7, a magnetic connection, in the exemplary embodiment having two individual magnet parts or magnetizable parts 12, 13, is provided. One magnet part 12 or 13 may also be sufficient if the other center part as a whole is formed to be magnetizable.

Figure 8:
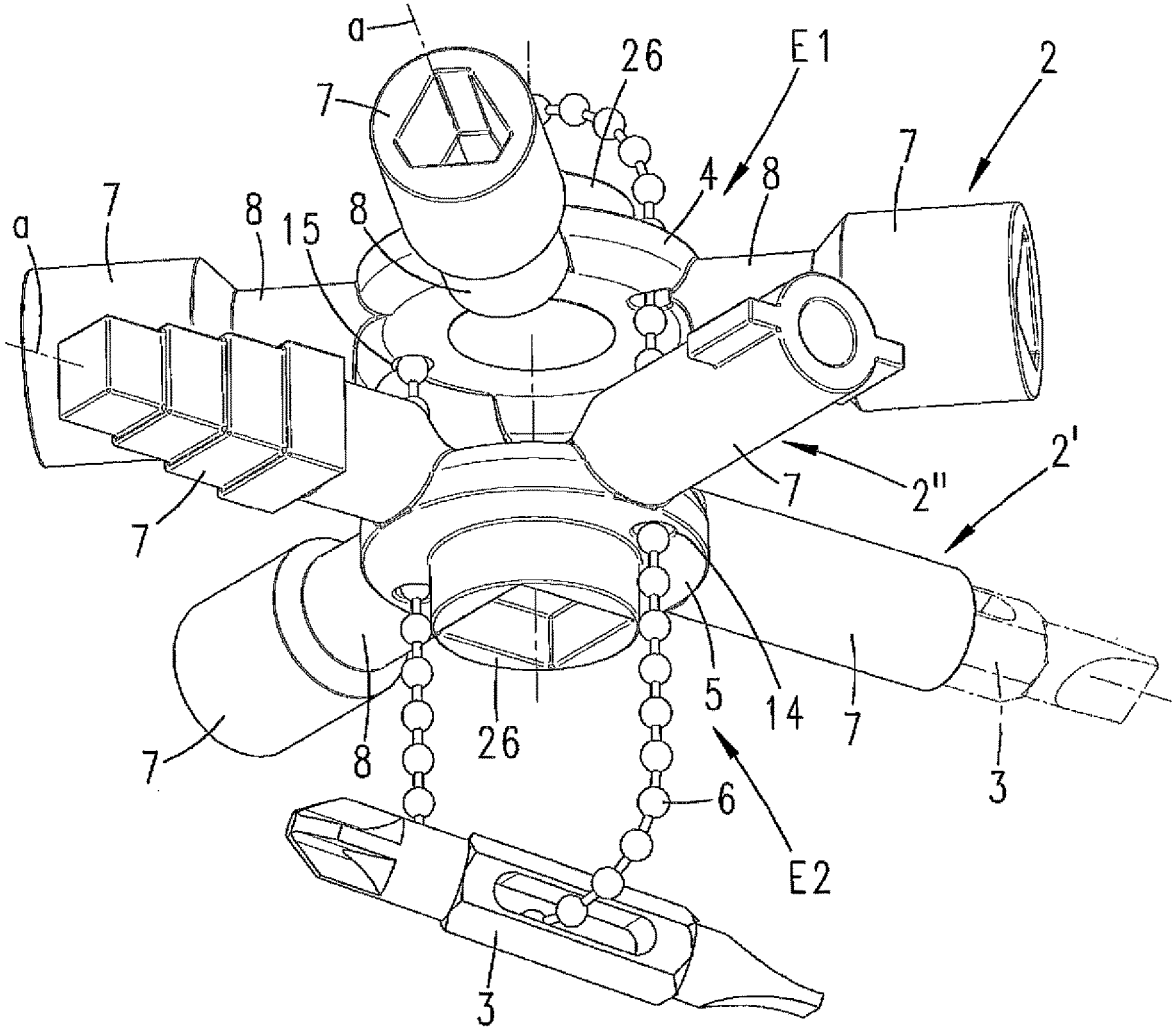
FIG. 8 shows an illustration corresponding to FIG. 4, but with a different type of connection of the separated center parts to one another.

In the embodiment in FIG. 8, the connecting chain 6 is guided in both center parts 4, 5 through two openings 14, 15, respectively. When only the chain is held, this facilitates in particular the two parts automatically finding one another and latching together, for example when a magnetic lock is provided. This may also be provided in other embodiments in each case.

It is also important that, in any event for the embodiment of FIGS. 1 to 8, but also providable for the other embodiments in each case, the center part 4 or 5 itself has a key formation 26, in the present case in the shape of a triangle having cut-off vertices. It is apparent that this key formation opens perpendicularly to the key heads of the keys 2.

In particular for the embodiments of FIGS. 1 to 8, but also possible for the embodiments described in greater detail below, it is also preferred that keys of different lengths are provided, in particular, with reference to the embodiments of FIGS. 1 to 8, that all keys belonging to a unit $E_1$ or $E_2$ in each case are made longer or shorter, respectively. Thus, the keys used most frequently may be provided on a unit $E_1$, which has only the longer keys, while the shorter keys provided for the unit $E_2$ are used less frequently based on experience. A shorter key is shorter than the key having the shortest length of the longer keys. Thus, in the majority of applications, it is not necessary to separate the units $E_1$, $E_2$ from one another, since the shorter keys, which preferably extend on the angle bisector between the longer keys, do not interfere on account of the different length provided. In principle, this is provided in FIG. 2, for example, with regard to the double-bit insert 3, which in this case belongs to unit $E_2$ (see FIG. 4, for example), while the adjacent keys which belong to $E_1$ have a much shorter length, so that the working portion of the double-bit insert in the illustrated operating position protrudes far enough that use is made possible without disassembling the parts $E_1$, $E_2$.

FIGS. 9*a* to 9*e* show typical key heads. FIG. 9*a* shows a square, FIG. 9*b* shows a double bit, FIG. 9*c* shows a stepped external square, FIG. 9*d* shows a crescent key, FIG. 9*e* shows a comparatively large screwdriver head, and FIG. 9*f* shows a polygon socket screwdriver head.

FIGS. 10*a* to 10*e* show comparable designs; FIGS. 10*a*, 10*b*, and 10*e* show triangle variants; and FIGS. 10*c* and 10*d* show square variants.

In the embodiment according to FIGS. 11 to 16, a plurality of individual keys 2, 2', 2" is provided in each case with a plate portion 16 at the base of the key. In the exemplary embodiment, this plate portion is circular in plan view, with an internal circular opening 17. The opening 17 is also preferably central with respect to the plate portion 16. One key 2 is formed in each case, preferably in one piece, on a region of the outer edge of the plate portion 16. The thickness of a shank 18 of the key 2 exceeds the thickness of the plate portion 16. In the handling state according to FIG. 11, the keys 2 are lined up one on top of the other on a center part 4 which defines a common axis 19. As is apparent from FIG. 15, for example, the common axis 19 is composed in particular of two interlocking axis parts 19', 19", the axis part 19' having an internal thread and the axis part 19" having an external thread. The two axis parts are joined to one another by a screw connection. Both axis parts 19' and 19" are provided so that they extend from a retaining plate 20.

Due to the screw combination, it being possible to provide, here also, possibly as an alternative, a detent combination or a magnetic combination, for example, the retaining plates 20 may be taken apart, and one or more keys may thus be removed or added. A user may in particular in this way put together an individual combination of control cabinet keys.

The control cabinet keys 2 in the embodiment in FIG. 11 to 16 are provided so that they are rotatable relative to one another in their respective plane. For use, a control cabinet key 2, as illustrated in FIG. 16, may thus be freely turned, control cabinet keys 2, 2', 2" which neighbor each other in addition allowing the required torque to be applied during use.

FIG. 12 in particular also shows that the individual control cabinet keys 2 in this embodiment are each situated in different planes with respect to their geometric center axes a.

In the embodiment in FIGS. 17 to 22, at the end, i.e., the base region, the multiplicity of control cabinet keys 2, 2', and 2" is formed together with a slide block having a rectangular or square cross-section. In plan view, the slide block represents a portion of a circular ring. By means of these slide blocks 21, in this embodiment (see in particular FIG. 21) the control cabinet keys 2 are situated in a slideway 22 formed by the center parts 4, 5 of this embodiment. The center parts 4, 5 each represent a shell part, and in the exemplary embodiment, preferably are operationally non-detachably connected to one another. Such a connection, established, for example, by crimping or some other reshaping action, cannot be separated by the user. The shell parts are assembled perpendicular to a plane in which one or more keys 2 extend. The shell parts each have an annular shape. As is apparent in particular from FIG. 21, the shell parts overlap on the inside, but leave an opening 23 free in the radially outward direction. This opening 23 is preferably circumferential with no interruptions. At the same time, the opening forms the exit gap for the tapered base region of the key 2 between a key shank and the slide block.

The keys 2, which in each case preferably extend in the same plane with respect to their geometric axes, are displaceable relative to one another on a circular base which is determined by the slideway.

The same as for the embodiment previously described, in this case a key 2 may, as it were, be freely turned, for handling.

In further detail, the shell parts are clamp-mounted against one another. For this purpose, clamping tongues 27 are cut free on an overlapping shell part, in the exemplary embodiment preferably starting approximately from a center plane. It is apparent that a multiplicity of clamping tongues 27 is provided over the periphery.

Within the scope of the present description, the keys and also preferably the center parts are preferably steel parts or sheet steel parts. These may also be cast steel parts, for example, in any event with regard to the keys.

A development of the embodiment in FIGS. 1 to 8 is described with reference to FIGS. 23 to 25.

In principle, all statements regarding the above-mentioned embodiment in particular, regarding the keys per se and other unchanged portions, as well as the other statements in the description of the figures, also apply to the present embodiment. Only the special features highlighted below are different. However, these features may also be implemented in the mentioned embodiment of FIGS. 5 to 8.

Only control cabinet keys of greater length L are provided on one of the center parts, in the present case the center part 4 (also see FIG. 24), while on the other center part only control cabinet keys of shorter length l are provided.

A greater length L is in particular greater than a shorter length l by 10% or more, or even up to four times greater, for example.

It is also of particular importance (see FIG. 23 in particular) that an exterior bit key 7 (also see FIG. 9*b*) has a length L such that an imaginary extension V of the bottom edge 28 of a bit, transverse, i.e., at right angles, to a geometric longitudinal axis a of this key, extends above an adjacent control cabinet key 7, namely, in the present case a control cabinet key of shorter length l, and in particular, at a distance x, shown in the illustration according to FIG. 23, i.e., in the top view, which preferably corresponds to one-tenth or more of the shank thickness 11 in the cylindrical region of the control cabinet key 7 that has a key bit. The distance x further preferably corresponds to 5/10 to 15/10, preferably approximately 9/10 to 10/10, of the mentioned thickness 11.

It is also preferred that a polygon socket 29 is composed of two or more polygon sockets 30, 31 having different key widths. Thus, the polygon socket 31 having a smaller key width is provided at a greater depth in the key head than the polygon socket 30 of greater key width. The transition is preferably provided via a step 33.

It is also preferred that, also corresponding to the illustration in FIG. 7, a holding magnet 12, 13 is situated, for example adhesively bonded, in the two center parts 4, 5, respectively.

A groove-like depression 34 which surrounds a holding magnet 12 or 13 is preferably provided in the respective center part 4 or 5. This groove-like depression may be provided circumferentially, and is also preferably formed in the shape of a circular segment, but also preferably does not merge together.

This groove-like depression 34 has the advantage, for example, that damping material may be accommodated there which may, for example, damp the noise resulting from joining together the parts of the control cabinet key. The damping material may be foam, for example. Additionally or alternatively, this depression 34 may also be used as a holding space for small parts such as small screws or the like, which may then be suitably held there under corresponding action by the magnet, also directly held by the magnets. Certain auxiliary parts which may be used in this regard may also be easily accommodated there, for example by wedging or simply only inserting them, appropriate care being necessary upon opening. The auxiliary parts may also be accommodated in a retaining material such as foam, for example.

With reference to the illustration according to FIG. 25, it is also preferred that a radial distance Y, which, from a center axis M of the combination or a specific part of the combination up to a transition U into the greater thickness 11 of a control cabinet key, is different with regard to different control cabinet keys of the same part of the combination; i.e., a distance $Y_1$ is smaller, for example, than the distance Y. Both distances have the same length in the illustration in FIG. 25, which also corresponds to a preferred configuration.

In particular, however, it is also preferred that, although for oppositely situated keys according to the illustration in FIG. 25, the distances Y, $Y_1$ are equal, and for the other keys of the same part of the combination the distances Y, $Y_1$ are also equal, these distances are smaller than the distances between the keys illustrated in FIG. 25.

With regard to the shorter distances, it is also preferred to provide a flattened area 35 on a center part, in the present case, the center part 5 (see FIG. 24), which results in a positionally unambiguous association of the parts of the combination, and furthermore (optionally additionally) prevents twisting of the parts of the combination relative to one another.

Two of these types of flattened areas 35 are preferably oppositely situated on the same center part 5 in a mirror-image configuration with respect to the center axis M. When there is only one flattened area, it is also possible to provide an unambiguous association of the center parts, and thus of the keys with respect to one another, the respective proximity being determined.

As is further apparent, the keys having an inner edge also have an exterior shape that corresponds to this inner edge, thus, for example, a trihedral inner edge or a pentahedral inner edge, etc.

All features disclosed are (in themselves) pertinent to the invention. The disclosure content of the associated/accompanying priority documents (copy of the prior application) is also hereby included in full in the disclosure of the application, including for the purpose of incorporating features of these documents in claims of the present application. The subsidiary claims in their optional subordinated formulation characterize independent inventive development of the prior art, in particular to undertake divisional applications based on these claims.

The invention claimed is:

1. Combination of control cabinet keys, the combination comprising:

a first unit and a second unit with individual keys, the first unit and the second unit each having their own center part, wherein the keys extend radially from the respective center part at a fixed acute angle between 20 degrees and 45 degrees relative to one another such that two keys of the keys extend opposed to each other without overlapping with the respective center part, wherein the center parts, seen in a top view, overlap each other in a combined state of the first unit and the second unit radially inside with respect to feet of the keys, wherein due to a fixed connection allowing no relative movement between the keys of the first unit or the second unit, respectively, and the respective center part, a torque may be applied to one of the keys that is used during handling, wherein the units are detachably connected at their center parts by magnetic force, wherein in the combined state the keys of the first unit and the second unit extend, starting from a same height band, at base areas of the keys which are associated with their center parts, wherein in the combined state the keys of the first unit extend in projection between two keys of the second unit without crossing each other in a direction starting from the base areas to the free end, and wherein at least one of the keys has a greater length than each of the two keys immediately neighboring the at least one of the keys.

2. Combination according to claim 1, wherein one unit is provided with only longer control cabinet keys, and the other unit is provided with only shorter control cabinet keys.

3. Combination according to claim 1, wherein at least one of the center parts comprises a groove-like depression surrounding a holding magnet of the respective center part.

4. Combination according to claim 1, wherein a first key of the keys is a stepped external square, a second key of the keys is a triangle key, and a third key of the keys is an insert bit.

5. Combination of control cabinet keys, the combination comprising:

a first unit and a second unit each having individual keys, the first unit and the second unit each having their own center part, wherein the keys extend radially from the respective center part at a fixed acute angle relative to one another, wherein the center parts, seen in a top view, in a combined state overlap each other radially inside with respect to feet of the keys, wherein due to the fixed connection between the keys, a torque may be applied during handling to a key that is used, wherein the first and the second units are detachably connected at their center parts by magnetic force, wherein the center parts have a respective opening disposed radially inward from the feet of the keys merging into the center parts, and a connector extending through the openings of the center parts, the connector captively holding the first unit and the second unit in a separated state of the first unit and the second unit, the connector holding additionally an insert bit.

6. Combination of control cabinet keys, the combination comprising:

a first unit comprising a first unit center part and four first unit keys extending radially from the first unit center part at right angles relative to one another and each being formed as one part with the first unit center part, and a second unit comprising a second unit center part and four second unit keys extending radially from the second unit center part at right angles relative to one another and each being formed as one part with the second unit center part, wherein the first unit center part and the second unit center part, seen in a top view, in a combined state overlap each other radially inside with respect to feet of the keys, wherein due to the fixed connection between the keys, a torque may be applied during handling to one of the keys that is used, wherein the first and the second units are detachably connected at their center parts by magnetic force, wherein in the combined state each key of the four first unit keys extends between two keys of the four second unit keys, wherein in the combined state each key of the four second unit keys extends between two keys of the four first unit keys, and wherein in the combined state the four first unit keys and the four second unit keys extend as a whole in a star shape with respect to the first unit center part and the second unit center part.

7. Combination according to claim 6, wherein the units are connected to one another so that they are separable, but are also connected captively, i.e., so that they are not completely removable.

8. Combination according to claim 6, wherein a base portion of a key in a connected state of the units extends in a direction of extent of the key, overlapping with the two center parts.

9. Combination according to claim 6, wherein the units are connected to one another by clamping.

10. Combination according to claim 6, wherein in the case of control cabinet keys provided on different units, one unit is provided with only longer control cabinet keys, and the other unit is provided with only shorter control cabinet keys.

11. Combination according to claim 6, wherein the two units have a common axis composed of two interlocking axis parts.

12. Combination according to claim 11, wherein the axis parts are joinable to one another by a screw connection.

13. Combination according to claim 11, wherein one or both axis parts extend starting from a retaining plate.

14. Combination of control cabinet keys according to claim 11, wherein a key has a plate portion at its base which has an opening suitable for the common axis to pass through.

15. Combination according to claim 6, wherein a length of a control cabinet key of greater length exceeds a length of a control cabinet key of shorter length by 10% or more.

16. Combination according to claim 15, wherein the length of the control cabinet key of greater length exceeds the length of the control cabinet key of shorter length by up to 400%.

17. Combination of control cabinet keys according to claim 6, wherein a control cabinet key of greater length has a key bit, and wherein a bottom edge of the key bit in an imaginary extension at right angles to a longitudinal axis of this key, in the plane of the control cabinet keys mounted on a center part, does not encounter an adjacent key, at least on one side.

18. Combination according to claim 17, wherein the extension does not encounter an adjacent key on either side.

19. Combination according to claim 6, wherein a key is designed as a polygon socket, and wherein a plurality of key widths is provided over the depth of the polygon socket.

20. Combination according to claim 19, wherein the transition of the key widths has a step-like configuration.

21. Combination according to claim 6, wherein an exterior key shape of a first key of the keys conforms to an interior key shape of the first key.

22. Combination according to claim 6, wherein a base portion of a key in a connected state of the units extends in a direction of extent of the key, overlapping with the two center parts.

23. Combination according to claim 6, wherein at least one of the center parts comprises a key formation, wherein the key formation opens perpendicularly to a direction of key heads of the keys of the respective first unit or second unit.

24. Combination according to claim 6, wherein the keys have a respective key head selected from the group consisting of a square, a double bit, a stepped external square, a crescent, a screwdriver, and a polygon socket screwdriver.

* * * * *